US007105785B2

(12) United States Patent
Kanzaki et al.

(10) Patent No.: US 7,105,785 B2
(45) Date of Patent: Sep. 12, 2006

(54) HIGH FREQUENCY HEATING APPARATUS WITH STEAM GENERATING FUNCTION

(75) Inventors: Kouji Kanzaki, Yamatokoriyama (JP); Yuji Hayakawa, Nara (JP); Masaharu Tsujimoto, Nara (JP); Toshifumi Kamiya, Yamatotakada (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 285 days.

(21) Appl. No.: 10/433,710

(22) PCT Filed: Jan. 15, 2003

(86) PCT No.: PCT/JP03/00280

§ 371 (c)(1),
(2), (4) Date: Jun. 4, 2003

(87) PCT Pub. No.: WO03/105535

PCT Pub. Date: Dec. 18, 2003

(65) Prior Publication Data

US 2005/0087528 A1 Apr. 28, 2005

(30) Foreign Application Priority Data

Jun. 5, 2002 (JP) ..... 2002-164862
Jul. 25, 2002 (JP) ..... 2002-216388

(51) Int. Cl.
*H05B 6/80* (2006.01)
*F22B 1/02* (2006.01)

(52) U.S. Cl. ..... 219/682; 219/756; 219/401; 99/451; 122/DIG. 11

(58) Field of Classification Search ..... 219/682, 219/681, 756, 757, 401; 99/451; 122/DIG. 11; 392/406
See application file for complete search history.

(56) References Cited

U.S. PATENT DOCUMENTS

| | | | | |
|---|---|---|---|---|
| 4,366,357 | A | 12/1982 | Satoh | |
| 5,242,375 | A * | 9/1993 | McDonough | 600/22 |
| 6,040,564 | A * | 3/2000 | Ueda et al. | 219/682 |
| 6,232,587 | B1 * | 5/2001 | Kurita et al. | 219/682 |
| 2005/0006382 | A1 * | 1/2005 | Hayakawa et al. | 219/682 |

FOREIGN PATENT DOCUMENTS

| | | | | |
|---|---|---|---|---|
| EP | 0 952 400 A1 | | 10/1999 | |
| FR | 2 820 500 | * | 8/2002 | |
| JP | 62-36522 | * | 2/1987 | 73/305 |

* cited by examiner

*Primary Examiner*—Philip H. Leung
(74) *Attorney, Agent, or Firm*—Pearne & Gordon LLP

(57) ABSTRACT

The object of the invention is to provide a high-frequency heating apparatus which has simple configuration, in which leakage into the apparatus from a water tank is prevented without large-sizing the apparatus, which is not influenced by heat from a heating chamber and which is sanitary and provides ease of use. To achieve the object, the high-frequency heating apparatus 100 provided with a high frequency generator that supplies a high frequency to the heating chamber for housing an object to be heated and a steam generator that generates steam in the heating chamber for supplying at least either a high frequency or steam to the heating chamber and heating the object to be heated is provided and the water tank for supplying water to the steam generator is arranged in any position on the outside face of the high-frequency heating apparatus 100 so that the water tank can be detached.

27 Claims, 30 Drawing Sheets

FIG. 20C1
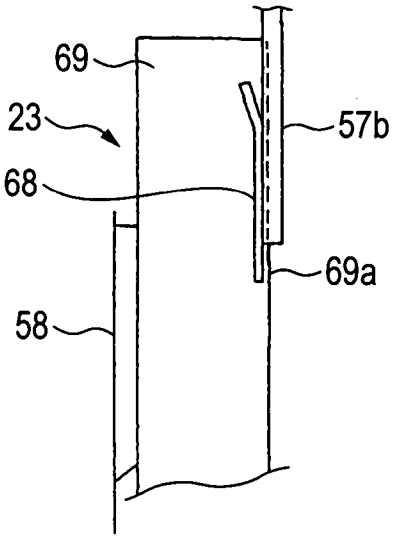
FIG. 20C2
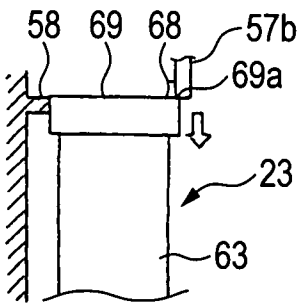
FIG. 20B1
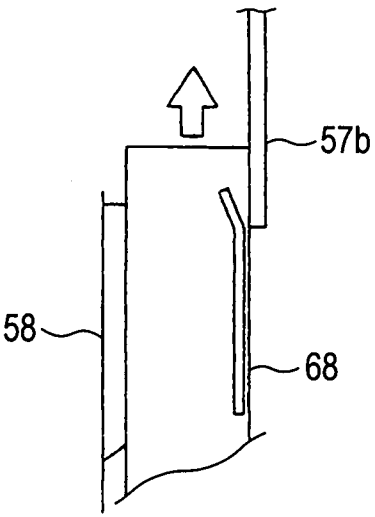
FIG. 20B2
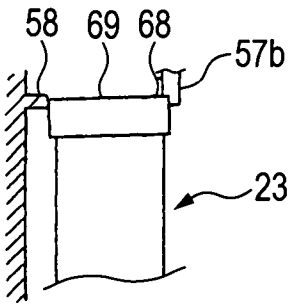
FIG. 20A1
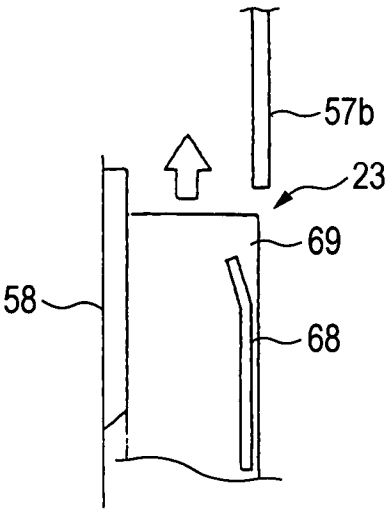
FIG. 20A2
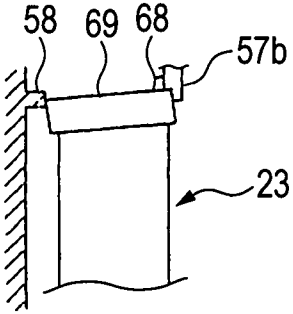

HIGH FREQUENCY HEATING APPARATUS WITH STEAM GENERATING FUNCTION

TECHNICAL FIELD

The present invention relates to a high-frequency heating apparatus that heats an object to be heated by combining high-frequency heating and steam heating.

BACKGROUND ART

For a conventional type high-frequency heating apparatus, there are a type having only one function of high-frequency heating and a combination oven provided with a convection heater that generates a hot air in addition to high-frequency heating, and a high-frequency heating apparatus that a high frequency and steam can be supplied to a heating chamber is also discussed. For a high-frequency heating apparatus to which a steam generating function is added, various methods including a method of providing a boiler outside a heating chamber and leading steam generated from the boiler into the heating chamber are proposed.

Recently, a high-frequency heating apparatus the volume of the heating chamber of which is increased by arranging an operator panel at a hatch, arranging a control circuit at the bottom, using the whole front of the body for a hatch and further thinning a wall forming a heating chamber up to the minimum has been adopted.

For a water supply method for generating steam of the high-frequency heating apparatus provided with a steam generating function, there are a method of directly supplying water to a water reservoir heated by a heater and a method of supplying water from a water tank connected to a steam generator. However, in the method of directly supplying to the water reservoir, when water in the reservoir is heated, it is evaporated and condensed, a so-called scale such as calcium and magnesium included in the water is deposited and adheres to the inside face of a heater and the reservoir. Therefore, the thermal efficiency of evaporation is deteriorated, the reservoir is required to be frequently cleaned and it is not desirable sanitarily. Every time an object to be heated is heated, water is required to be supplied to the reservoir, a heating process itself is troublesome and it is a difficulty of such an apparatus.

In that respect, a method of supplying from a water tank is excellent in ease of use, however, the method of using a water tank also has the following problems. First, in case a water tank cannot be detached from a high-frequency heating apparatus, the inside of the water tank is insanitary. When a water tank is simply attached to a high-frequency heating apparatus, the body size of the high-frequency heating apparatus is expanded, the area for installing the apparatus is expanded and the saving of space becomes impossible. Further, when a water tank is arranged inside a high-frequency heating apparatus, water may penetrate into a control circuit into which water should not penetrate and when penetrating water remains in the body, a sanitary problem is caused. Further, as a heating chamber and a water tank are arranged close, heat caused as a result of heating an object to be heated from the heating chamber may be transmitted into the water tank.

As described above, it is desirable from the viewpoint of space for installation that a water tank is arranged in a high-frequency heating apparatus compactly, however, from the viewpoint of the leakage of water from the water tank and the transmission of heat from a heating chamber, it is desirable that the water tank is provided outside the high-frequency heating apparatus. Therefore, the arrangement of a water tank with ease of use by which all problems can be solved at a time has been desired. Particularly, the limit of the usable temperature of a pump for supplying water in a water tank to a steam generator is low and overheat by the transmission of heat is required to be prevented possibly.

DISCLOSURE OF INVENTION

The invention is made in view of such conventional problems and the object is to provide a high-frequency heating apparatus which is sanitary and can provide facility, which has simple and compact configuration, which can prevent water leakage from a water tank and which is not influenced by heat from a heating chamber.

To achieve the object, a high-frequency heating apparatus according to first aspect of the invention that supplies at least either of a high frequency or steam to the heating chamber and heats the object to be heated, the high-frequency heating apparatus comprises a high frequency generator that supplies a high frequency to a heating chamber in which the object is accommodated, a steam generator that supplies steam to the heating chamber, and a water tank for supplying water to the steam generator which is detachably arranged outside face of the high-frequency heating apparatus.

In the high-frequency heating apparatus, as the water tank can be easily detached from the high-frequency heating apparatus and can be cleaned by arranging the water tank in any position on the outside face of the high-frequency heating apparatus so that the water tank can be detached, the high-frequency heating apparatus can have configuration which is sanitary and can provide ease of use.

A high-frequency heating apparatus according to the second aspect of the invention is characterized in that the water tank is housed in a wall forming a heating chamber of the high-frequency heating apparatus and can be detached by extracting the water tank from the front side of the high-frequency heating apparatus after the water tank is pulled outside the high-frequency heating apparatus from the wall.

In the high-frequency heating apparatus, quantity in which the water tank is protruded outside the high-frequency heating apparatus when the water tank is detached is reduced by detaching the water tank from the front side of the high-frequency heating apparatus after the water tank is pulled outside the high-frequency heating apparatus from the wall, and configuration in which the water tank can be attached/detached can be realized without large-sizing the apparatus.

A high-frequency heating apparatus according to the third aspect of the invention is characterized in that the maximum thickness of the water tank is equivalent to a half wavelength or a shorter wavelength of a supplied high frequency.

In the high-frequency heating apparatus, the water tank can be housed in the wall of the high-frequency heating apparatus without large-sizing the apparatus by setting the thickness of the water tank to thickness equivalent to a half wavelength of a high frequency or a shorter wavelength.

A high-frequency heating apparatus according to the fourth aspect of the invention is characterized in that at least a part of the side of the water tank is made of material that transmits light.

In the high-frequency heating apparatus, the quantity of water in the water tank is visible from the outside by making at least a part of the side on which a level of water in the water tank can be verified of material that transmits light and the control of the residual quantity of water in the water tank is facilitated.

A high-frequency heating apparatus according to fifth aspect of the invention is characterized in that a fluorescent back plate is provided opposite to the surface on the side of the heating chamber of the water tank in a state in which the water tank is attached to the high-frequency heating apparatus.

In the high-frequency heating apparatus, as water in the water tank looks colored from the outside by providing the back plate, the visibility of a water level is greatly enhanced and the apparatus can have configuration with ease of use and excellent in appearance.

A high-frequency heating apparatus according to the sixth aspect of the invention is characterized in that a scale showing a level of water in the water tank is formed on the back plate.

In the high-frequency heating apparatus, the scale can be attached by only bonding the back plate provided with the scale to the side of the heating apparatus and the manufacturing cost can be reduced.

A high-frequency heating apparatus according to the seventh aspect of the invention is characterized in that a scale showing a water level is provided to the water tank.

In the high-frequency heating apparatus, a level of water can be easily read from the scale by directly providing the scale to the water tank both in a state in which the water tank is singly extracted and in a state in which the water tank is attached to the heating apparatus. In case the scale is integrated with the body of the tank by injection molding, it can be attached at a low cost.

A high-frequency heating apparatus according to the eighth aspect of the invention is characterized in that a reflector that displays a level of water in the water tank on the front side of the high-frequency heating apparatus is protruded from the outside face of the water tank.

In the high-frequency heating apparatus, a level of water in the water tank can be easily verified even if the water tank is seen from the front of the apparatus in a state in which the water tank is attached to the heating apparatus.

A high-frequency heating apparatus according to the ninth aspect of the invention is characterized in that the reflector is a triangular prism.

In the high-frequency heating apparatus, the reflector can be formed at a low price by using the triangular prism for the reflector and though the triangular prism is low-priced, a water level can be visibly verified.

A high-frequency heating apparatus according to the tenth aspect of the invention is characterized in that the reflector is a mirror the reflecting surface of which is inclined on the side of the water tank.

In the high-frequency heating apparatus, a level of water is reflected at high reflectance and is displayed by using the mirror for the reflector and the water level can be visibly verified.

A high-frequency heating apparatus according to the eleventh aspect of the invention is characterized in that a guide for regulation made of a plate stood in a direction in which the water tank is inserted on the upper surface of the water tank, a side guide on the side of the high-frequency heating apparatus where the water tank is housed which is extended on one side of the water tank in an inserted direction and which is touched to the side of the water tank and an upper guide made of a plate, hanging from the upside of the water tank and touched to a face on the reverse side to the side of the side guide of the guide for regulation are provided and the upper guide is slid on the guide for regulation as the water tank is inserted along the side guide.

In the high-frequency heating apparatus, the water tank is pressed on the side guide by fitting the upper guide on the side of the high-frequency heating apparatus to the guide for regulation made of a plate and stood on the upper surface of the water tank and an inserted position of the water tank is regulated.

A high-frequency heating apparatus according to the twelfth aspect of the invention is characterized in that the upper guide is hung up to a position of the upper surface of the water tank.

In the high-frequency heating apparatus, the lower surface of the upper guide runs on the side of the guide for regulation of the water tank and the water tank can be vertically regulated. Hereby, when a cap of the water tank is formed on the upper surface and is forgotten to be closed, it can be also securely closed by operation for inserting the water tank.

A high-frequency heating apparatus according to the thirteenth aspect of the invention is characterized in that a tank case covering the periphery of the water tank is provided in the wall.

In the high-frequency heating apparatus, as the water tank is housed in the tank case and the tank case is housed in the wall, the tank case receives water even if water leaks from the water tank and water can be prevented from directly splashing a control circuit of the high-frequency heating apparatus.

A high-frequency heating apparatus according to the fourteenth aspect of the invention is characterized in that the tank case is provided with the body of a tank case fixed on the side of the high-frequency heating apparatus, a tank case door member supported by the body of the tank case with an axis so that the tank case door member can be opened or closed for housing the water tank between the body of the tank case and the tank case door member and door fitting means for fitting the tank case door member to the body of the tank case and holding it in a closed state.

In the high-frequency heating apparatus, the water tank can be attached to the high-frequency heating apparatus by housing the water tank between the body of the tank case and the tank case door member and fitting the tank case door member by the door fitting means. The water tank can be extracted by releasing fitting by the door fitting means.

A high-frequency heating apparatus according to the fifteenth aspect of the invention is characterized in that the tank case door member can be pulled on the front side of the high-frequency heating apparatus by arranging the water tank on either side of the high-frequency heating apparatus and providing the axis on the rear side of the side of the high-frequency heating apparatus.

In the high-frequency heating apparatus, the tank case door member can be opened on the front side by providing the rotating axis of the tank case door member on the rear side of the side of the high-frequency heating apparatus and the water tank can be pulled out on the front side. Hereby, all normal operation is performed on the front side and the operability and ease of use of the high-frequency heating apparatus are enhanced.

A high-frequency heating apparatus according to the sixteenth aspect of the invention is characterized in that the door fitting means releases the fitting of the tank case door member when the door fitting means is pressed inside the high-frequency heating apparatus in a state in which the tank case door member is closed and fits the tank case door member in a closed state when the tank case door member is pushed back inside the high-frequency heating apparatus in a state in which the tank case door member is open.

In the high-frequency heating apparatus, by simple operation that the fitting of the tank case door member is released by pressing the door fitting means inside the high-frequency heating apparatus, the tank case door member is fitted by pushing back the tank case door member inside, the water tank can be attached or detached.

A high-frequency heating apparatus according to the seventeenth aspect of the invention is characterized in that a pump for supplying water from the water tank to the steam generator is arranged in the body of the tank case and a heat insulating plate for the pump is provided between the pump and the body of the tank case on the side of the heating chamber.

In the high-frequency heating apparatus, heat radiated from the side of the heating chamber can be interrupted by providing the heat insulating plate for the pump between the pump and the body of the tank case on the side of the heating chamber and the rise of the temperature of the pump can be inhibited.

A high-frequency heating apparatus according to the eighteenth aspect of the invention is characterized in that a side heat insulating plate is fixed via first space outside a side wall plate of the heating chamber, further, the tank case is fixed via second space outside the side heat insulating plate and a blower for supplying wind to at least the first space and the second space is provided.

In the high-frequency heating apparatus, the side wall plate of the heating chamber, the side heat insulating plate and the tank case are cooled by conveying wind from the blower to the first space and the second space and air is prevented from remaining in each space. Hereby, the effect by each space of thermal insulation is enhanced and as a result, the rise of the temperature of the pump 55 by heat from the side of the heating chamber can be inhibited.

A high-frequency heating apparatus according to the nineteenth aspect of the invention is characterized in that the tank case is provided with the body of the tank case fixed to the side of the high-frequency heating apparatus, a tank case door member supported by the body of the tank case so that the tank case door member can be opened or closed with a door axis for housing the water tank between the body of the tank case and the tank case door member and door fitting means for fitting the tank case door member to the body of the tank case and holding it in a closed state, the second space is space between the side heat insulating plate and the body of the tank case and further, wind from the blower is supplied to third space formed between the body of the tank case and the heat insulating plate for the pump.

In the high-frequency heating apparatus, the first, second and third spaces are formed between the pump and the heating chamber, the side wall plate of the heating chamber, the side heat insulating plate, the body of the tank case and the heat insulating plate for the pump are cooled by conveying wind to these spaces and air is prevented from remaining in each space. Hereby, the effect by each space of thermal insulation is enhanced and as a result, the rise of the temperature of the pump by heat from the side of the heating chamber can be inhibited.

A high-frequency heating apparatus according to the twentieth aspect of the invention is characterized in that wind from the blower is supplied to fourth space formed between the body of the tank case and the water tank.

In the high-frequency heating apparatus, the rise of the temperature of the water tank can be inhibited by supplying wind to the fourth space between the body of the tank case and the water tank.

A high-frequency heating apparatus according to twenty-first aspect of the invention is characterized in that the blower is a cooling fan for cooling a magnetron of the high-frequency heating part.

In the high-frequency heating apparatus, parts can be effectively utilized and the cost is reduced by using the cooling fan for cooling the magnetron for the blower.

A high-frequency heating apparatus according to twenty-second aspect of the invention is characterized in that the blower is arranged on the downside of the heating chamber of the high-frequency heating apparatus, a duct blasthole for leading wind sent from the blower to the side of the high-frequency heating apparatus is provided in a one-sided location in a direction of the depth of the side in an area including at least the downside of a position in which the pump is arranged.

In the high-frequency heating apparatus, wind flowing on the side of the water tank is collectively supplied and wind gains vigor. Therefore, wind can be efficiently blown, compared with a case that wind is supplied on average in a direction of the depth of the side and wind can be prevented from being stagnated.

A high-frequency heating apparatus according to the twenty-third aspect of the invention is characterized in that an opening for ventilation vertically open is formed on the side of the heating chamber at the bottom of the body of the tank case and a drip-proofing protrusion covering the opening vertically via clearance is protruded inside the tank case on a vertical wall on the side of the heating chamber in the vicinity of the bottom of the body of the tank case.

In the high-frequency heating apparatus, water dropping along the tank case from the side of the water tank can be prevented from directly dropping on a lower opening as it is by the waterproofing protrusion.

A high-frequency heating apparatus according to the twenty-fourth aspect of the invention is characterized in that a groove for dewatering formed toward the side end face on the reverse side to the side of the heating chamber of the body of the tank case is provided at the bottom of the body of the tank case.

In the high-frequency heating apparatus, a water drop is prevented from accumulating at the bottom of the body of the tank case, a water drop on the bottom smoothly moves and drops.

A high-frequency heating apparatus according to the twenty-fifth aspect of the invention is characterized in that a protrusion stood from the bottom of the body of the tank case for partitioning the bottom is provided.

In the high-frequency heating apparatus, a water drop on the bottom of the body of the tank case can be prevented from moving to another partition area on the bottom and even if water leaks, the whole bottom can be prevented from being dipped in water.

BRIEF DESCRIPTION OF THE DRAWINGS

FIGS. 20A1 to 20C2 are explanatory drawings showing operation for fitting a tank cap accompanied by operation for inserting the water tank;

BEST MODE FOR CARRYING OUT THE INVENTION

Figure 1:
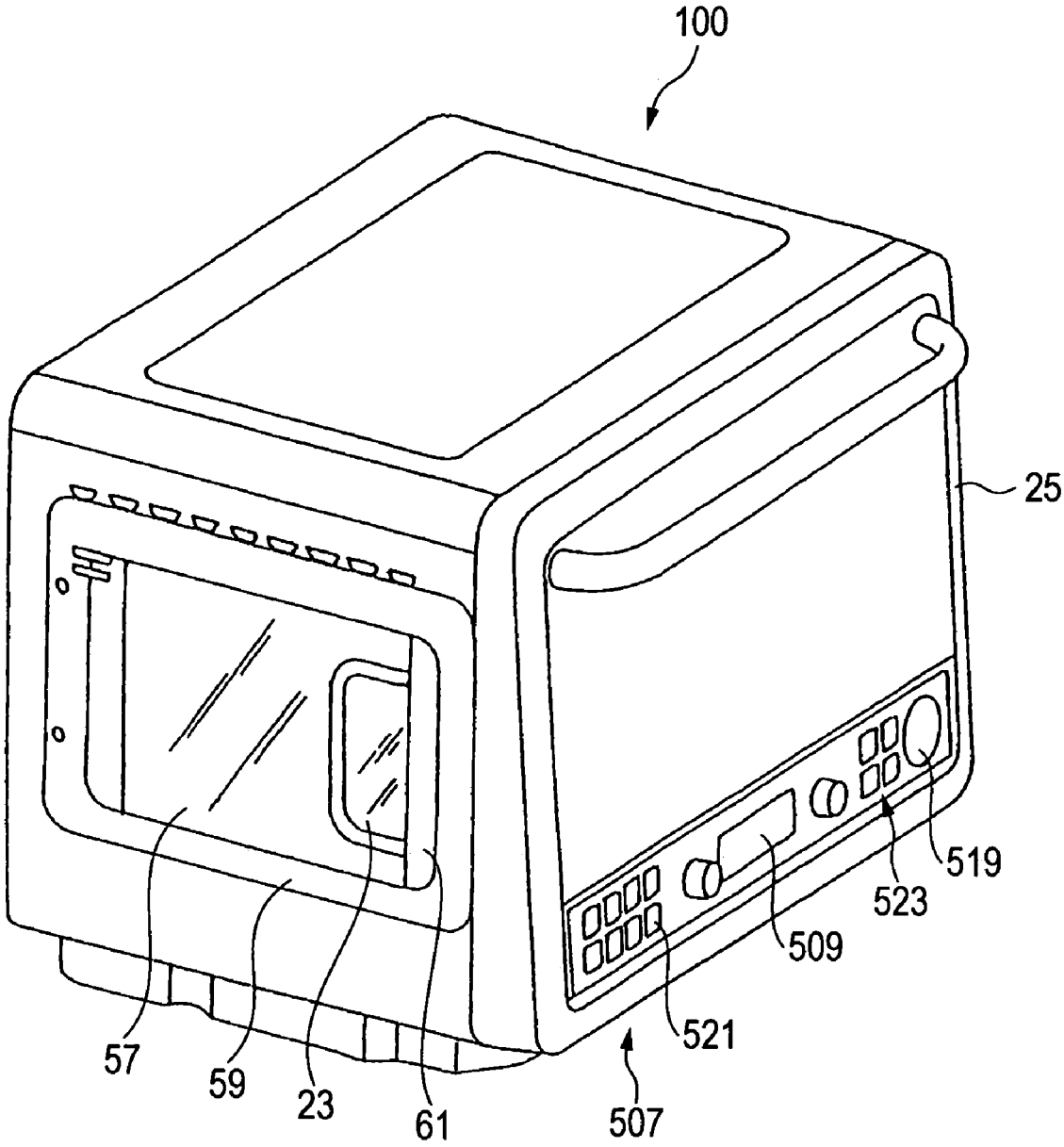
FIG. 1 is a perspective view showing the appearance of a high-frequency heating apparatus according to the invention.

Referring to the drawings, an embodiment suitable for a high-frequency heating apparatus according to the invention will be described in detail below.

Figure 2:
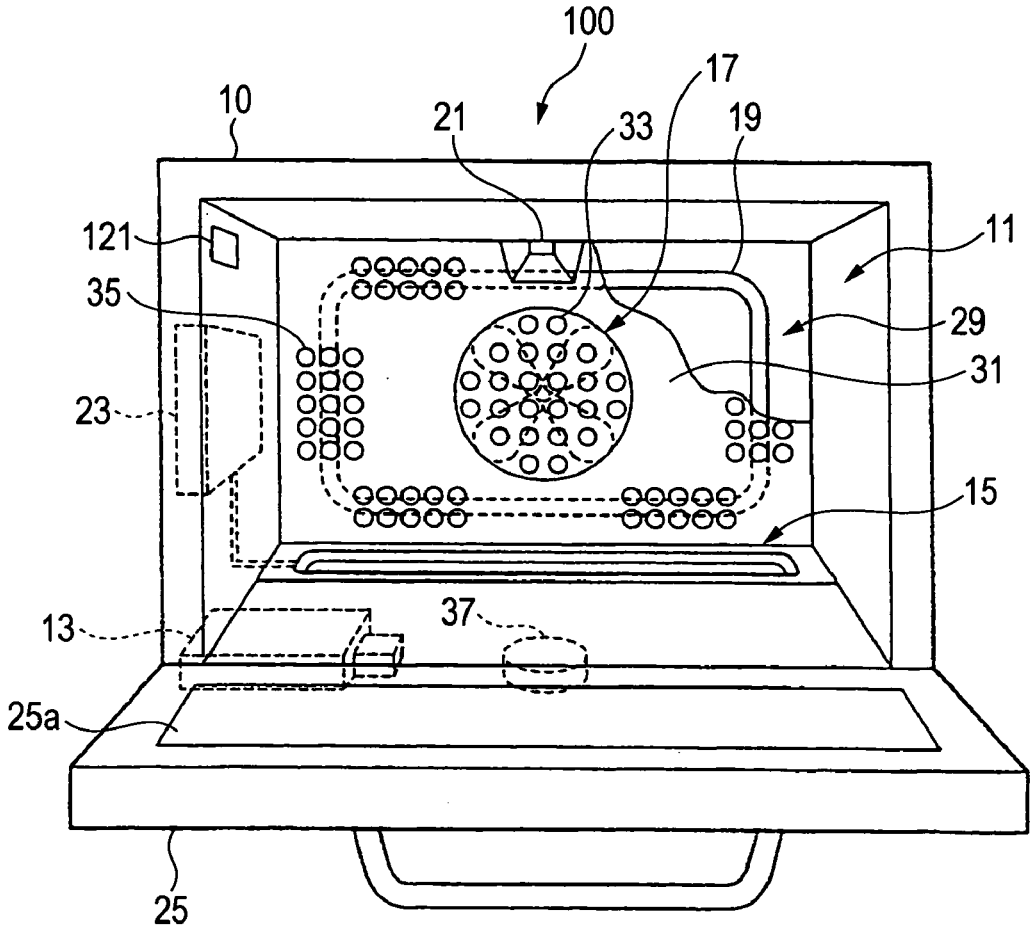
FIG. 2 is a schematic front view showing a state in which an opening/closing door of the high-frequency heating apparatus is open.
Figure 3:
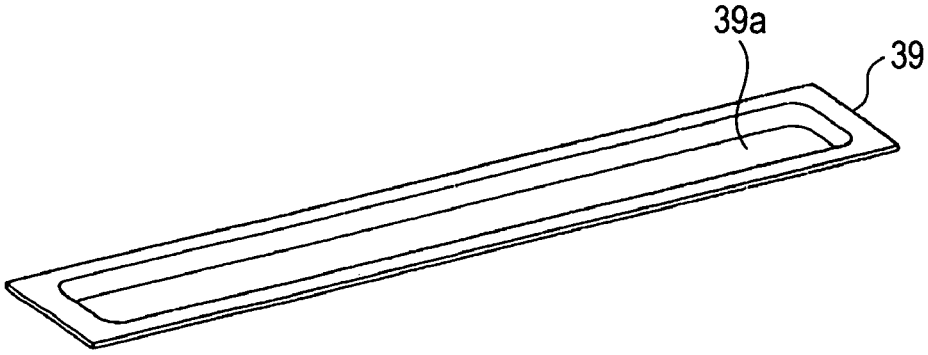
FIG. 3 is a perspective view showing an evaporation pan of a steam generator used in the high-frequency heating apparatus.
Figure 4:
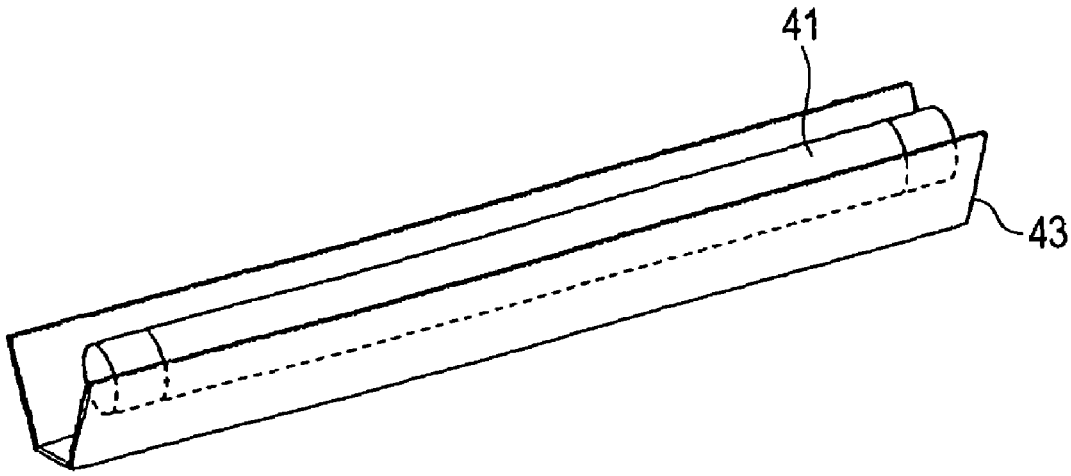
FIG. 4 is a perspective view showing an evaporation pan heater and a reflector of the steam generator.
Figure 5:
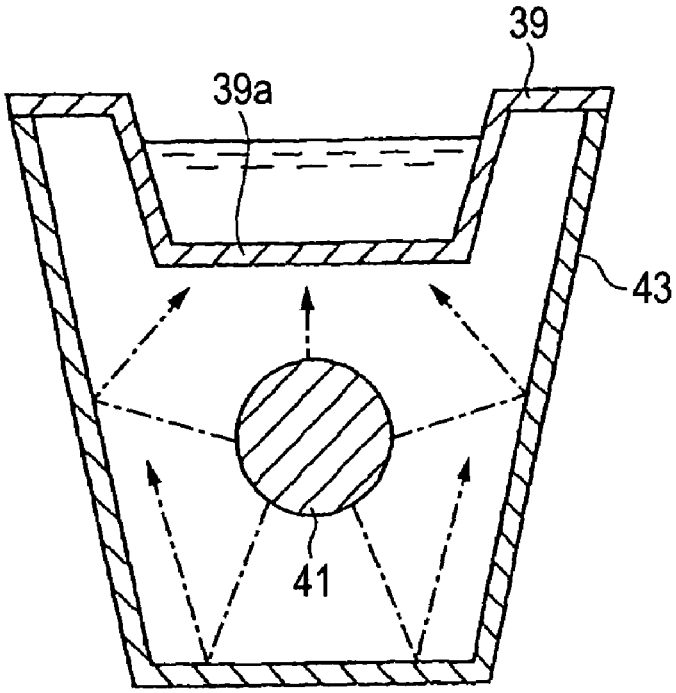
FIG. 5 is a sectional view showing the steam generator.

FIG. 1 is a perspective view showing the appearance of the high-frequency heating apparatus according to the invention, FIG. 2 is a schematic front view showing a state in which a door of the high-frequency heating apparatus is open, FIG. 3 is a perspective view showing an evaporation pan of a steam generator used in this apparatus, FIG. 4 is a perspective view showing an evaporation pan heater of the steam generator and a reflector and FIG. 5 is a sectional view showing the steam generator.

The invention is characterized in configuration that a water tank 23 for supplying water to a steam generator provided to a high-frequency heating apparatus 100 is located to the side of the high-frequency heating apparatus 100 so that the water tank can be detached as shown in FIG. 1. The basic configuration of the high-frequency heating apparatus 100 and the action will be described.

The high-frequency heating apparatus 100 is a heating cooling appliance that supplies at least either a high frequency (microwave) or steam to a heating chamber 11 for housing an object to be heated and heats the object as shown in FIGS. 1 and 2. The high-frequency heating apparatus is provided with a magnetron 13 as a high-frequency generator for generating a high frequency, a steam generator 15 that generates steam in the heating chamber 11, a circulating fan 17 for agitating and circulating air in the heating chamber 11, a convection heater 19 as an indoor air heater that heats air circulating in the heating chamber 11, an infrared ray sensor 21 that detects temperature in the heating chamber 11 via a hole for detection provided to the wall of the heating chamber 11 and the detachable water tank 23 connected to a supply channel to the steam generator 15 as primary components.

Figure 8:
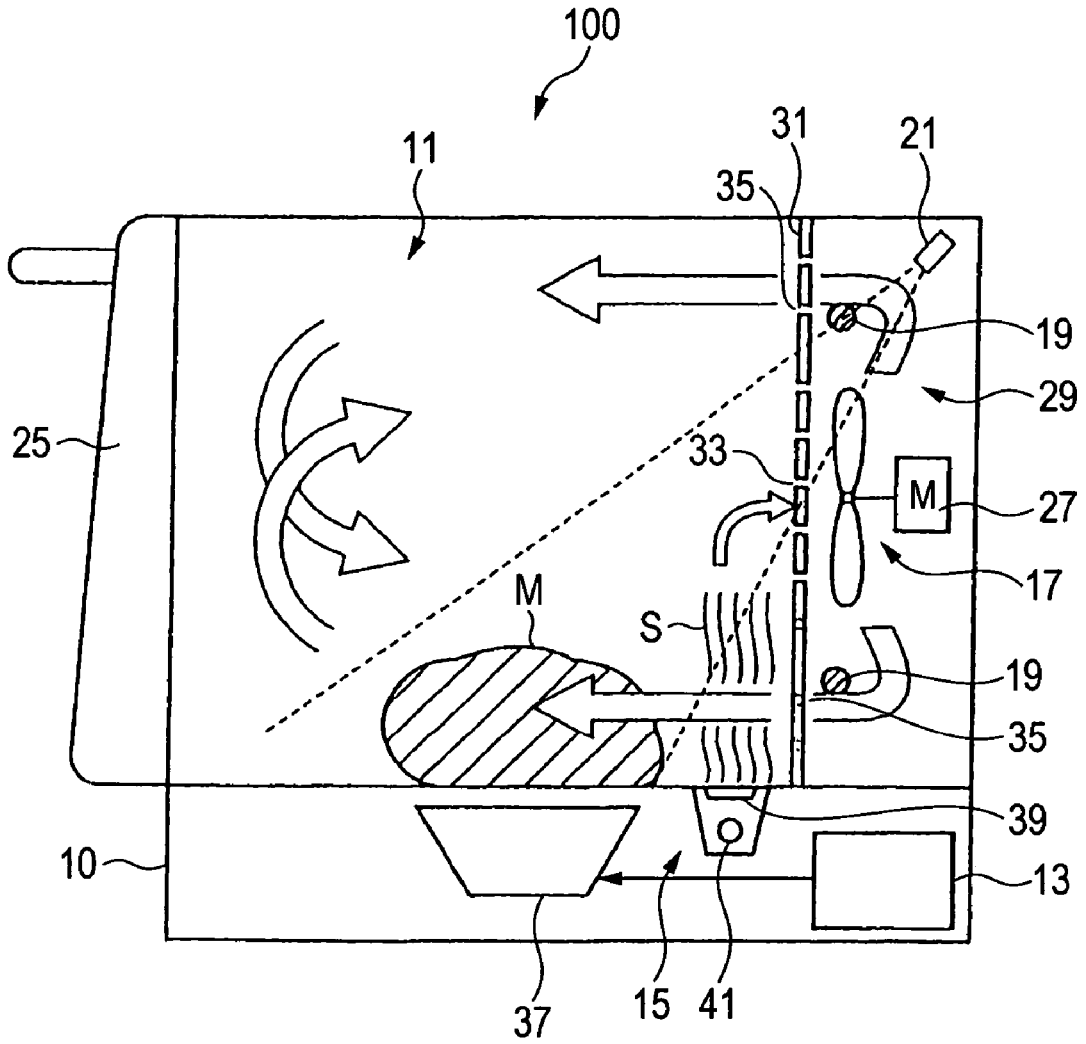
FIG. 8 is an explanatory drawing for explaining the operation of the high-frequency heating apparatus.

The heating chamber 11 is formed inside a box body case (a body) 10 the front of which is open and a door 25 provided with a light transmission window 25*a* for opening or closing an opening of the heating chamber 11 is provided to the front of the body case 10. As the lower end of the door 25 is coupled to the lower edge of the body case 10 via a hinge, the upper end is moved forward and backward with the lower end in the center of a turn and the door can be opened or closed. Predetermined heat insulating space is secured inside a wall between the heating chamber 11 and the body case 10 and heat insulating material is filled in the space if necessary. Particularly, space at the back of the heating chamber 11 functions as a circulating fan chamber 29 in which the circulating fan 17 and a motor 27 for driving it (see FIG. 8) are housed and the wall at the back of the heating chamber 11 functions as a diaphragm 31 that partitions the heating chamber 11 and the circulating fan chamber 29. A ventilating hole for intake 33 for the intake of air from the side of the heating chamber 11 to the side of the circulating fan chamber 29 and a ventilating hole for blast 35 for blast from the side of the circulating fan chamber 29 to the side of the heating chamber 11 are provided in different areas. Each ventilating hole 33, 35 is formed as multiple punched holes.

The circulating fan 17 is arranged in the center of the rectangular diaphragm 31 as the center of rotation and in the circulating fan chamber 29, the rectangular ring-shaped convection heater 19 is provided so that the convection heater surrounds the circulating fan 17. The ventilating holes for intake 33 formed on the diaphragm 31 are arranged on the front of the circulating fan 17 and the ventilating holes for blast 35 are arranged along the rectangular ring-shaped convection heater 19. As the circulating fan 17 is set so that wind caused by driving flows from the front side of the circulating fan 17 to the rear side on which the driving motor 27 is located, air in the heating chamber 11 is drawn in the center of the circulating fan 17 via the ventilating hole for intake 33, passes the vicinity of the convection heater 19 in the circulating fan chamber 29 and is sent into the heating chamber 11 via the ventilating hole for blast 35. Therefore, air in the heating chamber 11 is circulated via the circulating fan chamber 29 by this flow, being agitated.

The magnetron 13 is arranged in space under the heating chamber 11 and a stirrer vane 37 is provided to a position for receiving a high frequency generated by the magnetron 13. The high frequency is supplied to the heating chamber 11, being agitated by the stirrer vane 37 by radiating the high frequency generated by the magnetron 13 on the turned stirrer vane 37. The magnetron 13 and the stirrer vane 37 are not only provided at the bottom of the heating chamber 11 but may be also provided on the upper surface of the heating chamber 11 or on the side.

The steam generator 15 is composed of an evaporation pan 39 having a water reservoir concave portion 39*a* for generating steam by heating, an evaporation pan heater 41 arranged under the evaporation pan 39 for heating the evaporation pan 39 as shown in FIGS. 4 and 5 and a reflector 43 the cross section of which is substantially U type that reflects heat radiated from the heater 41 toward the evaporation pan 39 as shown in FIG. 3. The evaporation pan 39 is made of a stainless elongated plate for example, is arranged at the bottom of the inside on the reverse side to the heated thing hatch of the heating chamber 11 with the longitudinal direction along the diaphragm 31 and is provided outside a range of a temperature detection scan by the infrared ray sensor 21. For the evaporation pan heater 41, a glass tube heater, a sheathed heater and a plate heater can be utilized.

Figure 6:
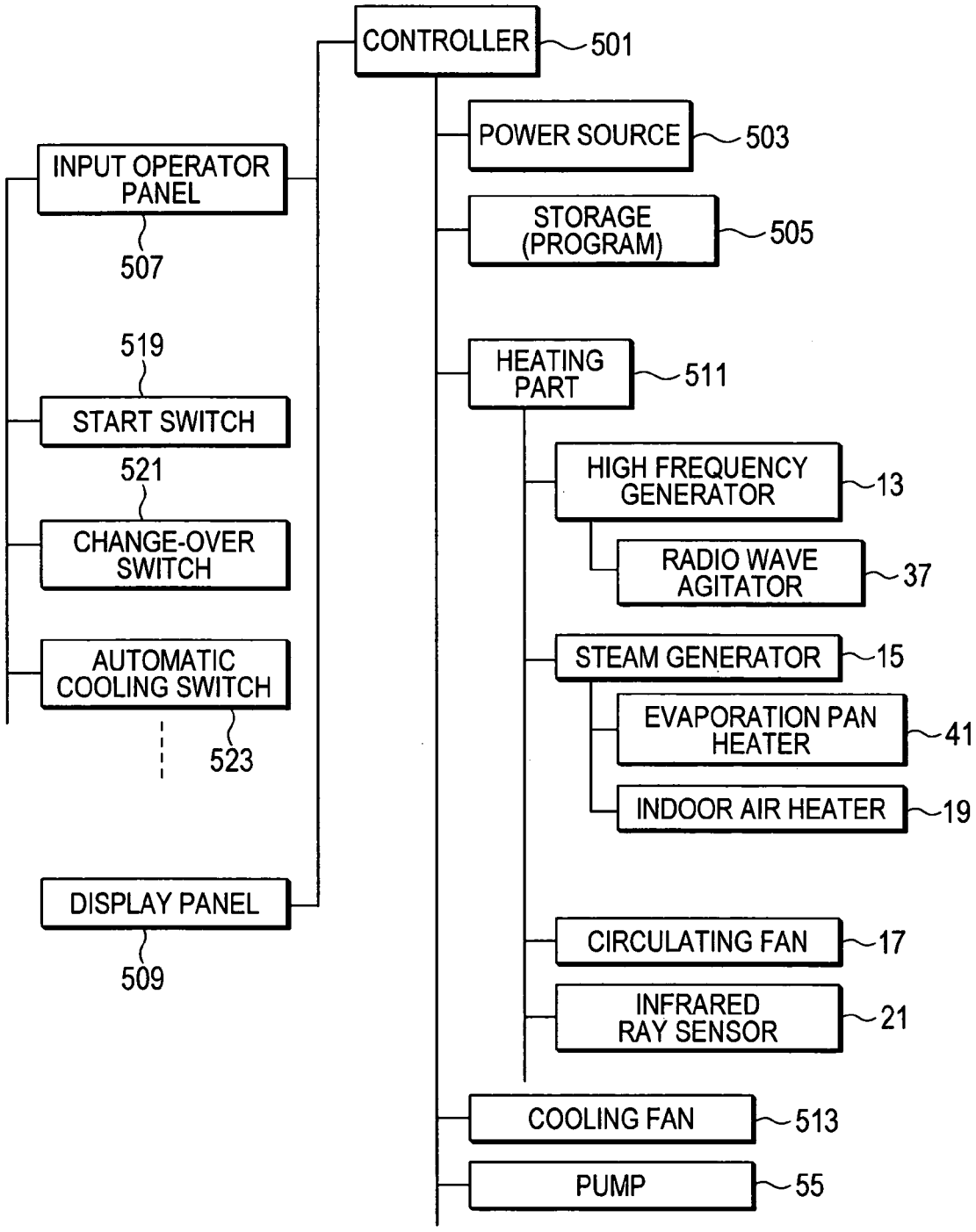
FIG. 6 is a block diagram showing a control system for controlling the high-frequency heating apparatus provided with the steam generator.

FIG. 6 is a block diagram showing a control system for controlling the high-frequency heating apparatus 100 provided with a steam generating function. The control system is mainly composed of a controller 501 provided with a microprocessor for example. The controller 501 mainly sends or receives a signal to/from a power source 503, a storage 505, an input operator panel 507, a display panel 509, a heating part 511 and a cooling fan 513 of a control circuit and a pump 55 for supplying water to the steam generator.

Various switches such as a start switch 519 that instructs the start of heating, a change-over switch 521 for switching a heating method including high-frequency heating and steam heating and an automatic cooking switch 523 for starting a heating program prepared beforehand are connected to the input operator panel 507.

The high-frequency generator 13, the steam generator 15, the circulating fan 17 and the infrared ray sensor 21 are connected to the heating part 511. The high-frequency generator 13 is operated in cooperation with the radio wave agitator (the stirrer vane) 37, and the evaporation pan heater 41 and the indoor air heater 19 (the convection heater) are connected to the steam generator 15.

Figure 7:
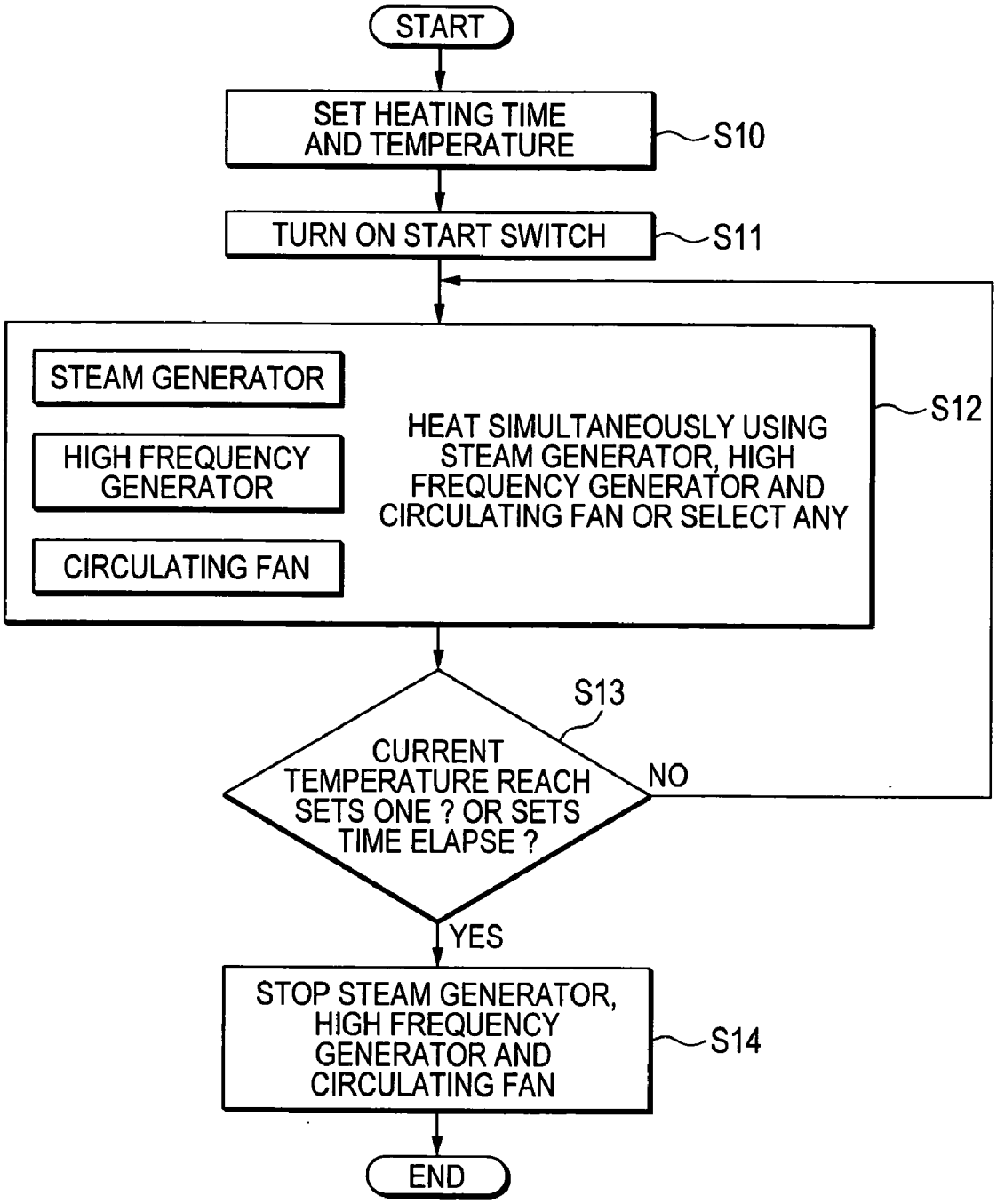
FIG. 7 is a flowchart for explaining the basic heating operation of the high-frequency heating apparatus.

Next, referring to a flowchart shown in FIG. 7, the basic heating operation of the high-frequency heating apparatus 100 will be described.

For a procedure for the operation, first, a food to be heated is put in the heating chamber 11 and the door 25 is closed. A heating method, heated temperature or time are set via the input operator panel 507 (a step 10, hereinafter abbreviated as S10) and the start switch 519 is turned on (S11). Then, a heating process is automatically executed by the operation of the controller 501 (S12).

That is, the controller 501 instructs the start of the heating process according to the set heating method, judges whether the current temperature or time reaches the set temperature or time or not based upon a signal from the infrared ray sensor 21 and a timer (S13), stops each heating source when the current value reaches the set value and finishes the heating process (S14). In S12, the generation of steam, the operation of the indoor air heater, the turn of the circulating fan and high-frequency heating are executed individually or simultaneously.

The action of a case that a heating mode of "the generation of steam and turning on the circulating fan" for example is selected and executed in the heating process will be described below. When this mode is selected, the evaporation pan heater 41 is turned on as shown in an operational explanatory drawing of the high-frequency heating apparatus 100 in FIG. 8, water in the evaporation pan 39 is heated and steam S is generated. Steam S rising from the evaporation pan 39 is absorbed in the center of the circulating fan 17 via the ventilating hole for intake 33 provided substantially in the center of the diaphragm 31 and is jetted toward the heating chamber 11 from the ventilating hole for blast 35 provided in the periphery of the diaphragm 31 via the circulating fan chamber 29. The jetted steam is agitated in the heating chamber 11 and is absorbed again on the side of the circulating fan chamber 29 via the ventilating hole for intake 33 substantially in the center of the diaphragm 31. Hereby, a circulating path is formed between the heating chamber 11 and the circulating fan chamber 29. No ventilating hole for blast 35 is provided under a position in which the circulating fan 17 is arranged of the diaphragm 31 to lead the generated steam S to the ventilating hole for intake 33. Steam is jetted toward the heated thing M by making steam S circulate in the heating chamber 11 as shown by void arrows in FIG. 8.

At this time, the temperature of steam that circulates in the heating chamber 11 can be set to high temperature by turning on the indoor air heater 19. Therefore, so-called superheated steam is acquired and heating cooking for burning the surface of the heated ting M is also enabled. In the case of high-frequency heating, a high frequency is supplied, being agitated in the heating chamber 11 by turning on the magnetron 13 and turning the stirrer vane 37 and an even high-frequency heating process is enabled.

Next, the action by the basic configuration of the high-frequency heating chamber 100 will be described.

According to the high-frequency heating apparatus 100, as steam is generated inside the heating chamber 11, a part for generating steam, that is, the evaporation pan 39 can be easily cleaned as in a case that the heating chamber 11 is cleaned. For example, in a process in which steam is generated, calsium, magnesium and a chlorine compound in water are condensed and may be precipitated and adhere at/to the bottom of the evaporation pan 39 as scale, however, in that case, the evaporation pan can be cleaned by only wiping the scale which adheres to the surface of the evaporation pan 39 with cloth. In case the evaporation pan is particularly contaminated, it is extracted outside the heating chamber 11 and may be also cleaned and the cleaning of the evaporation pan 39 is simple. According to circumstances, the evaporation pan can be also easily replaced with a new one. Therefore, the inside including the evaporation pan 39 of the heating chamber 11 can be more easily cleaned and it is facilitated to always keep the inside of the heating chamber sanitary environment.

In the high-frequency heating apparatus 100, as the evaporation pan 39 is arranged at the bottom of the inside on the reverse side to the heated thing (M) hatch of the heating chamber 11, it does not prevent operation for extracting the heated thing M, even if the temperature of the evaporation pan 39 is high, a hand does not touch the evaporation pan 39 when the heated thing M is put or extracted and the high-frequency heating apparatus is excellent in safety. As the evaporation pan 39 is arranged in a position substantially outside a temperature detection range by the infrared ray sensor 21, the temperature of the heated thing M can be measured at high precision even if the evaporation pan 39 made at high temperature in the heating chamber exists.

Further, in the high-frequency heating apparatus 100, as the evaporation pan 39 is heated by the evaporation pan heater 41 and steam S is generated, steam can be supplied to the heating chamber with simple structure and efficiently and as steam having high temperature to some extent can be generated by heating, cooling requiring only humidification or cooling heated, preventing drying together with high-frequency heating is also enabled.

As heat radiated from the evaporation pan heater 41 is reflected toward the evaporation pan 39 by the reflector 43, it can be efficiently utilized to generate steam.

In the high-frequency heating apparatus 100, as air in the heating chamber 11 is circulated and agitated by the circulating fan 17, steam can be uniformly spread to the corners of the heating chamber 11 in heating by steam. Therefore, though steam is filled in the heating chamber 11, it does not remain, steam is spread in the whole heating chamber 11, as a result, when the temperature of the heated thing is measured by the infrared ray sensor 21, the infrared ray sensor 21 securely measures the temperature of the heated thing M without measuring the temperature of particles of steam in the heating chamber 11 and temperature detection precision is enhanced. Hereby, a heating process executed referring to the detected temperature can be suitably executed without a malfunction.

For a heating method, as both high-frequency heating and steam heating can be simultaneously executed, only either can be executed and both can be executed in predetermined order, a suitable heating method can be arbitrarily selected according to the type of a food and the classification of a frozen food or a refrigerated food. Particularly, as the rise of the temperature of a heated thing can be accelerated in case high-frequency heating and steam heating are both used, efficient cooling is enabled.

As air circulating in the heating chamber 11 can be heated by the indoor air heater 19 provided to the circulating fan chamber 29, the temperature of generated steam can be freely adjusted. For example, as the temperature of steam can be also set to high temperature of 100° C. or more, the temperature of a heated thing can be efficiently raised by superheated steam and according to circumstances, the surface can be also grilled by drying the surface of the heated thing. In case a heated thing is a frozen food, the thermal conduction is satisfactory because the heat capacity of steam is large and the frozen food can be thawed for short time.

Next, the arrangement which characterizes the invention of the water tank 23 of the high-frequency heating apparatus 100 will be described in detail.

For the primary configurational characteristics of the invention, the following three can be given. That is, (1) the water tank is arranged in any position on the outside face of the high-frequency heating apparatus 100 so that the water tank can be detached.

(2) Though the water tank 23 is arranged close to the heating chamber, it is hardly influenced by heat from the hating chamber.

(3) Even if water leaks from the water tank 23, a waterproofing measure for preventing the high-frequency heating apparatus 100 from being influenced by the leakage is taken.

First, the first characteristic that the water tank 23 is detachably arranged will be described in detail below.

Figure 9:
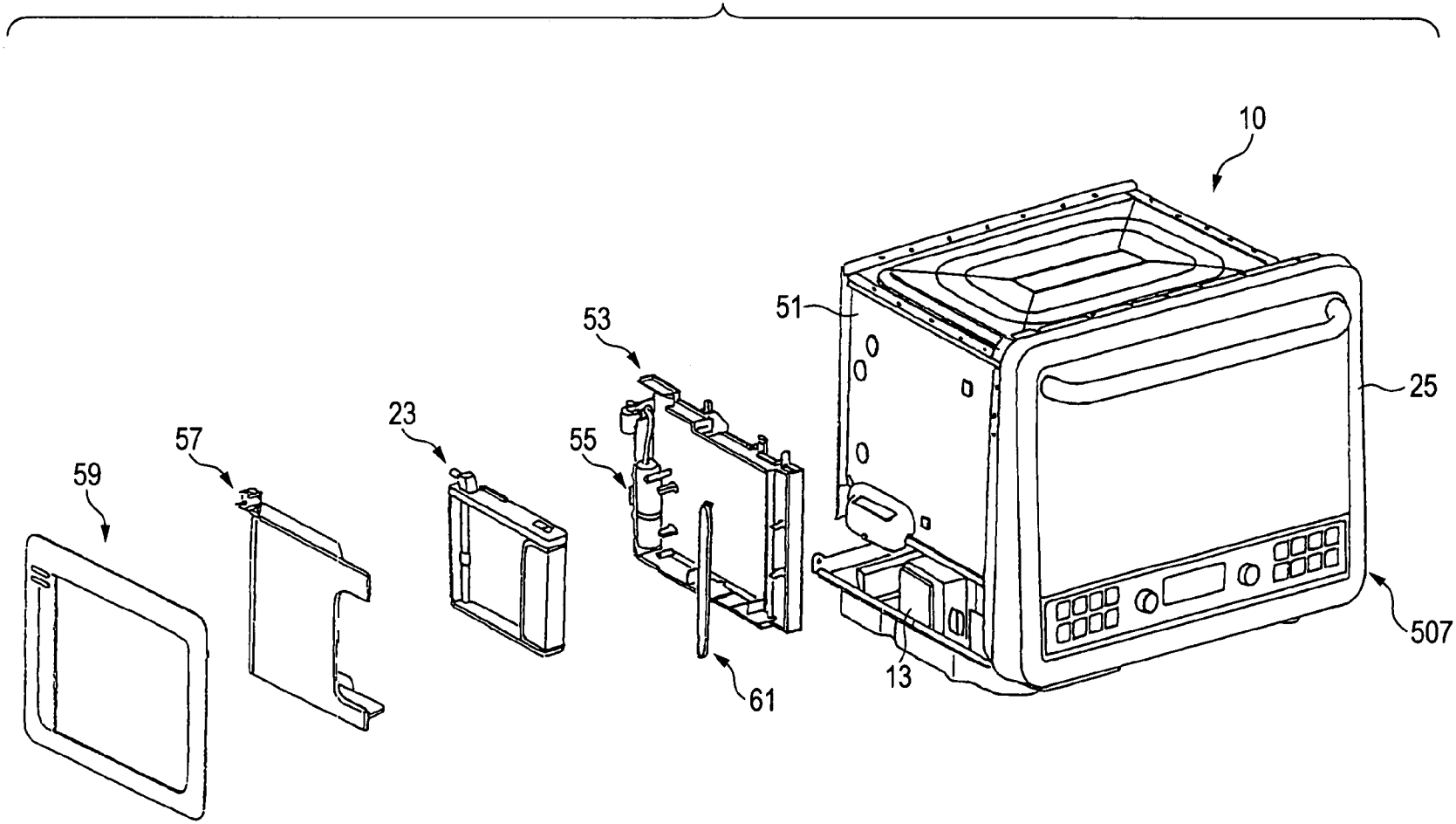
FIG. 9 is an exploded perspective view showing the configuration that a water tank is arranged on the side of the high-frequency heating apparatus.

FIG. 9 is an exploded perspective view showing configuration that the water tank is arranged on the side of the high-frequency heating apparatus. Though the details are described later, a side heat insulating plate 51 is fixed on the side of the high-frequency heating apparatus 100 with predetermined space (first space) between a side wall plate inside the heating chamber and the outside of the heating apparatus 100, and the body of a tank case 53 is provided to the side heat insulating plate 51 with the body apart from the side heat insulating plate 51 by predetermined space (second space). A pump for supplying water 55 is attached to the body of the tank case 53. A tank case door member 57 is rotatably supported by the body of the tank case 53 so that the door member can be opened or closed with respect to an axis. The water tank 23 is laid on the tank case door member 57 between the body of the tank case 53 and the tank case door member 57 and is housed inside the tank case door member. Further, a doorframe 59 is attached to the periphery of the tank case door member 57. An opening button (door fitting means) 61 for opening the tank case door member 57 is provided between the inside of the door frame 59 on the front side of the heating apparatus 100 and the water tank 23. The opening button 61 is provided with a fitting function of a fitting member (not shown) for binding the body of the tank case 53 and the tank case door member 57 and when fitting is released, the tank case door member 57 is pressed outside the heating apparatus 100 by an elastic member (not shown) pressed in a direction in which the door is opened.

The high-frequency heating apparatus 100 is provided with the appearance shown in FIG. 1 that the water tank 23 is housed in the high-frequency heating apparatus 100 by assembling each member described above.

Figures 10A, 10B, 10C:
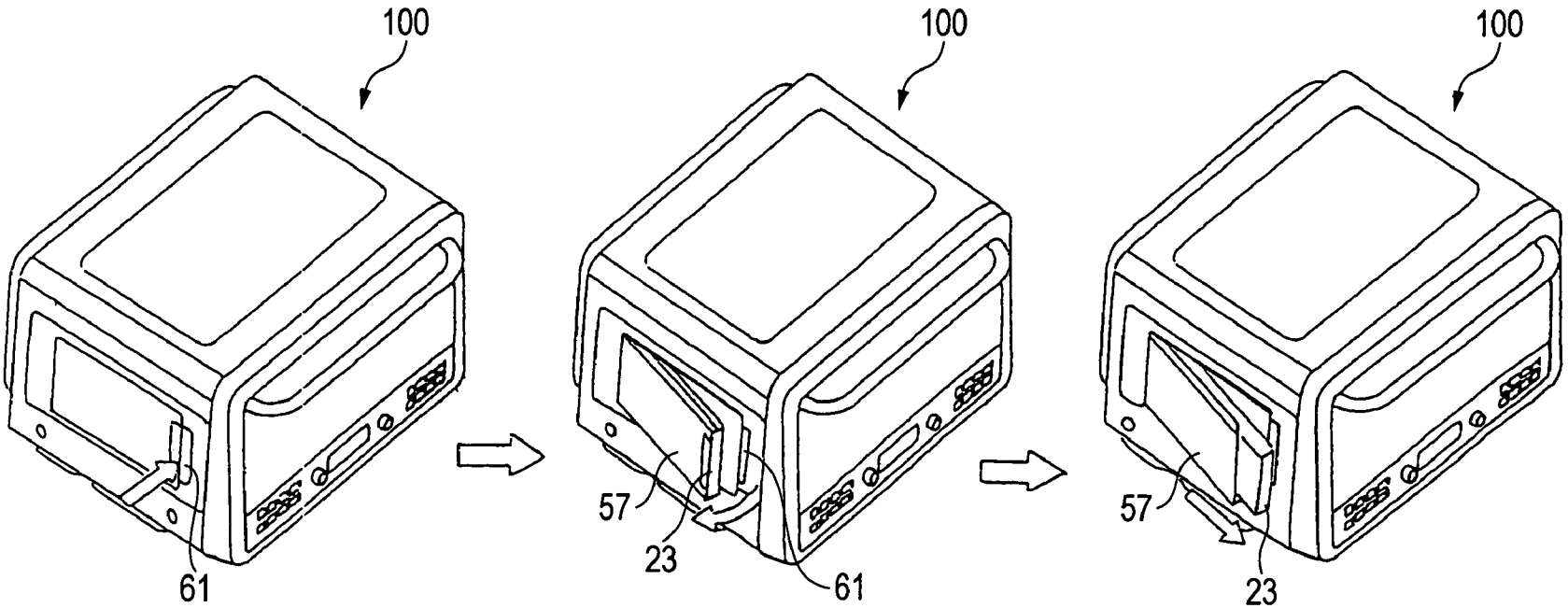
FIGS. 10A to 10C are explanatory drawings showing a procedure for extracting the water tank from the high-frequency heating apparatus.

Next, FIG. 10 show a procedure for taking the water tank 23 out from the high-frequency heating apparatus 100. The tank case door member 57 and the water tank 23 laid on the tank case door member are opened outside from the side of the heating apparatus 100 as shown in FIG. 10B by pressing the opening button 61 provided to the front side of the side of the high-frequency heating apparatus 100 inside the heating apparatus 100 as shown in FIG. 10A. As shown in FIG. 10C, the water tank 23 is taken out by pulling it on the front side of the heating apparatus 100.

In case the water tank 23 is housed, the water tank 23 is slid and inserted into the tank case door member 57 to the inside in a state in which the tank case door member 57 is open to the contrary to the procedure described above. The tank case door member 57 is fitted in a state in which it is closed by the fitting member (not shown) by pushing back the tank case door member 57 inside the heating apparatus 100.

Figure 11:
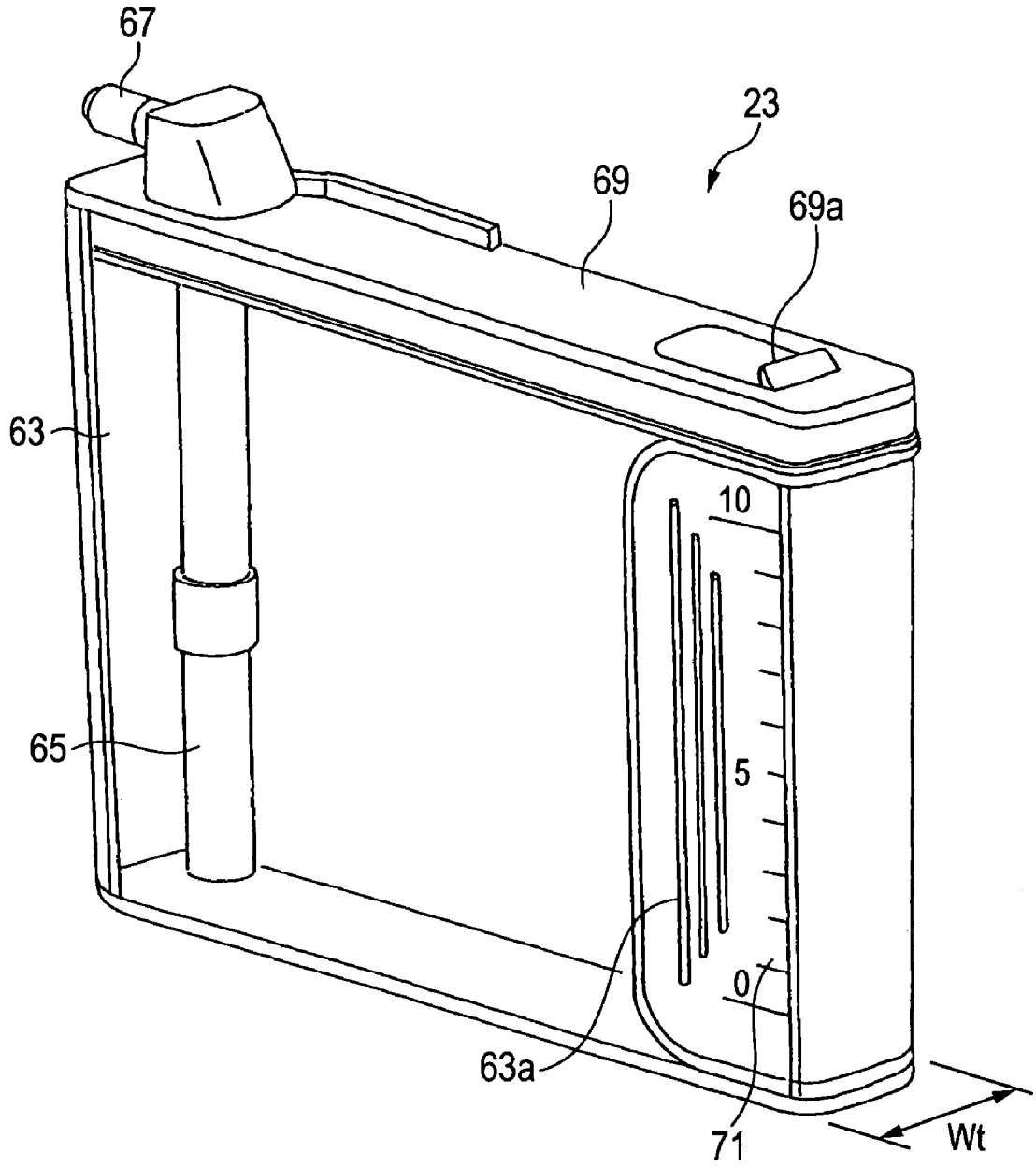
FIG. 11 is an enlarged perspective view showing the water tank.

The water tank 23 is in the shape of a flat rectangular parallelopiped as shown in an enlarged perspective view in FIG. 11 and is composed of the body of a tank 63 and a tank cap 69 to which an intake cylinder 65 and a supply port 67 are fixed and which can be detached from the body of the tank 63. A nonslip protrusion (or a groove) 63*a* when the water tank 23 is held is formed at one side end of the body of the tank 63, a pulling-out knob 69*a* used when the tank is taken out is formed on the upper surface of the tank cap 69 and operation for attaching or detaching the water tank 23 is facilitated. At least a part of the side of the body 63 of the water tank 23 is made of material that transmits light so that a level of water can be checked and a scale 71 showing the level of water in the tank is provided to any part of the body of the tank 63 which appears when the body of the tank 63 is attached to the heating apparatus 100. Hereby, residual water quantity in the water tank 23 can be easily read from the scale 71 both in a state in which the water tank 23 is extracted and in a state in which the water tank 23 is attached to the heating apparatus 100. In case the scale 71 is integrated with the body of the tank 63 by injection molding, the water tank can be attached at a low cost. The scale 71 may be also provided to the side of the heating apparatus 100 (for example, on a surface 53*a* on the side on which the body of the tank case 53 is attached (see FIG. 21)) so that a water level is shown across the water tank 23 when the water tank 23 is attached in addition to a case that the scale is provided to the body of the tank 63. Concretely, aback plate of fluorescent color which is easy to visually recognize or a back plate provided with a scale having black gradations on fluorescent backing for example is bonded on the side of the heating apparatus 100 opposite to the surface on the side of the heating chamber 11 of the water tank 23 in a state in which the water tank 23 is attached to the heating apparatus 100. Hereby, the back plate or the back plate provided with the scale has only to be bonded to the side of the heating apparatus 100 and the manufacturing cost can be reduced. As water in the water tank 23 looks colored from the outside by providing the back plate, the visibility of a water level is greatly enhanced and the heating apparatus can have the configuration easy to use and having beautiful appearance.

The back plate may be also a seal on which backing and gradations are printed and to the rear surface of which an adhesive is applied and may be also a plastic or metallic plate.

The water tank may also have the following configuration so that a water level in the water tank 23 can be easily checked even if the water tank is seen from the front of the apparatus in a state in which the water tank 23 is attached to the heating apparatus 100.

Figure 12:
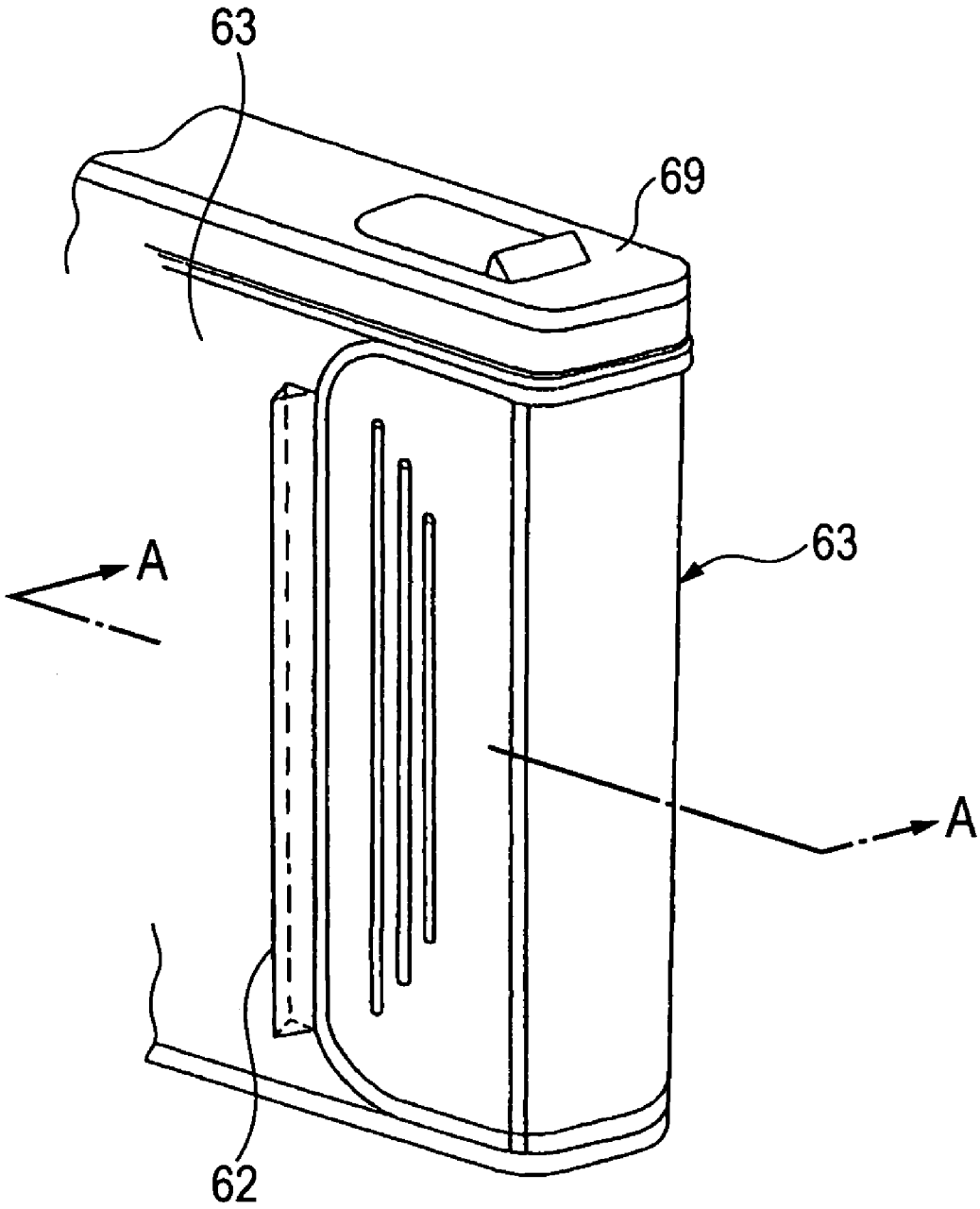
FIG. 12 is a perspective view showing the side end on the side on which the water tank is extracted.
Figure 13:
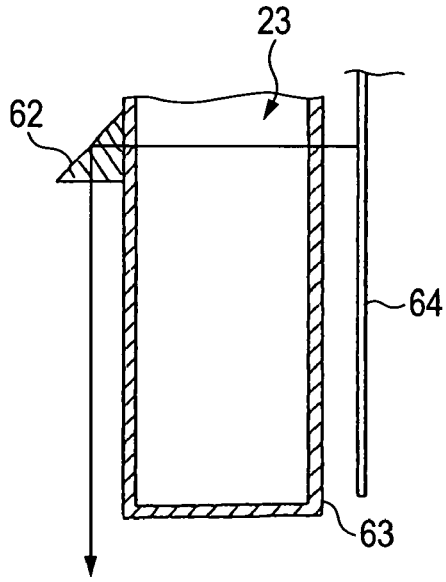
FIG. 13 is a sectional view viewed along a line A—A in FIG. 12.
Figure 14:
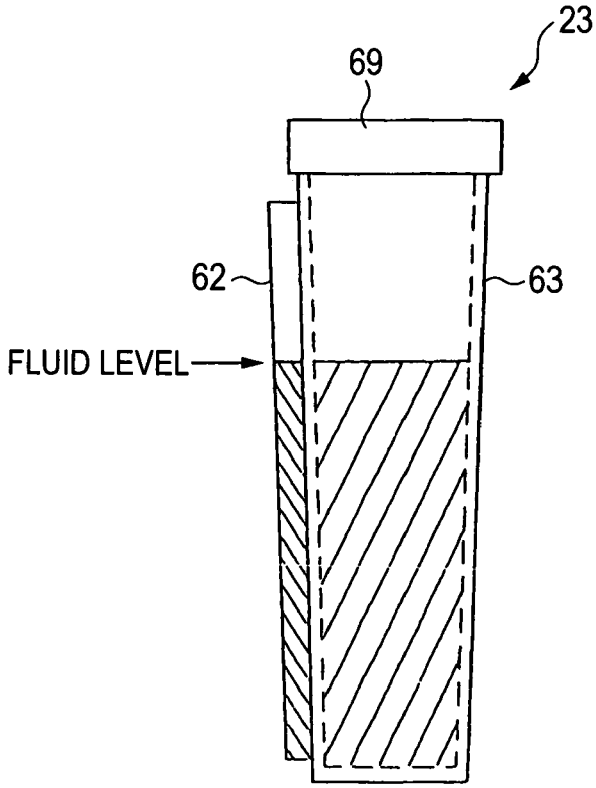
FIG. 14 is a schematic side view viewed from the side of the water tank.

FIG. 12 is a perspective view showing the side end on the side on which the water tank is extracted, a triangular prism 62 as a reflector is provided to the side of the body of the tank 63 of the water tank 23 as shown in a sectional view viewed along a line A—A in FIG. 12 in FIG. 13 and a water level in the water tank 23 is transferred in the prism 62 in the color of the back plate 64. In this configuration, in an area of the prism 62 equivalent to a part under the level of water in the water tank 23, the color of the fluorescent back plate 64 is displayed on this side in a direction shown by an arrow in the drawing and in the meantime, an area higher than the water level is not displayed with fluorescent color and is translucent. Therefore, in case the water tank 23 is viewed from the side, the level of water in the water tank 23 is displayed in the prism 62 as the color of the back plate 64 as schematically shown in FIG. 14. Hereby, as shown as a front view showing the whole heating apparatus in FIG. 15, the level of water in the water tank 23 can be also checked visibly from the front of the heating apparatus 100 by the prism 62 protruded outside from the water tank 23 though the configuration is low-priced configuration.

Figure 15:
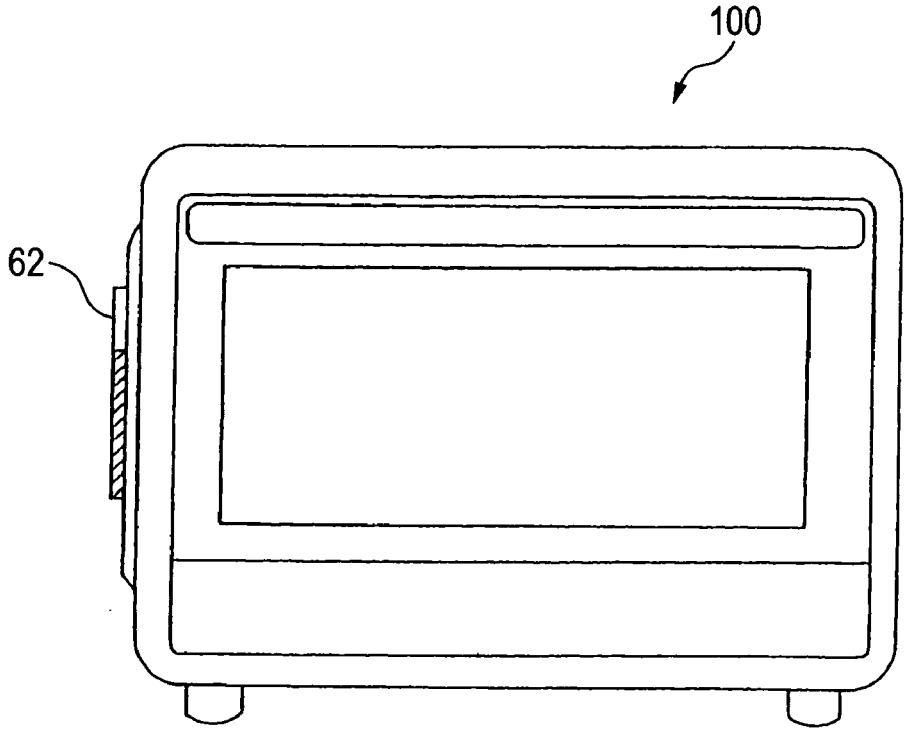
FIG. 15 is a front view showing the whole heating apparatus.
Figure 16:
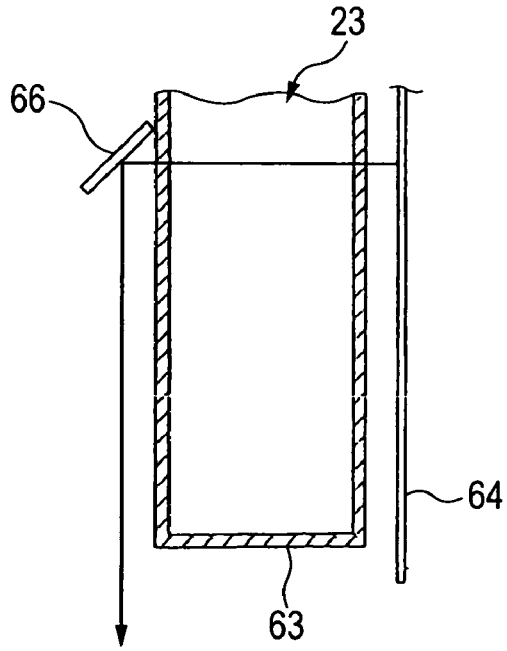
FIG. 16 is a sectional view showing an example in which a mirror is provided to the side of the body of the water tank with the mirror inclined.

For the reflector described above, even if a mirror is used in place of the prism 62, the similar action and effect are produced. FIG. 16 shows an example in which a mirror is used for the reflector. A mirror 66 the reflecting surface of which is inclined on the side of the water tank 23 is fixed to the side of the body of the tank 63 by a fixture not shown and the level of water in the water tank 23 is displayed in the color of the back plate 64 with high reflectance in a direction of the front of the heating apparatus 100. According to the configuration, the similar display of the level to that in FIG. 15 is also enabled.

As the body of the tank 63 and the tank cap 69 can be detached in the water tank 23, the water tank is provided with configuration in which the inside of the tank is easily cleaned and which is sanitary and has ease of use. As the thickness Wt of the water tank 23 is set to a small value, the thickness of the heating apparatus including the thickness of the water tank in case the water tank is attached to the heating apparatus 100 is prevented from being increased.

Figure 17:
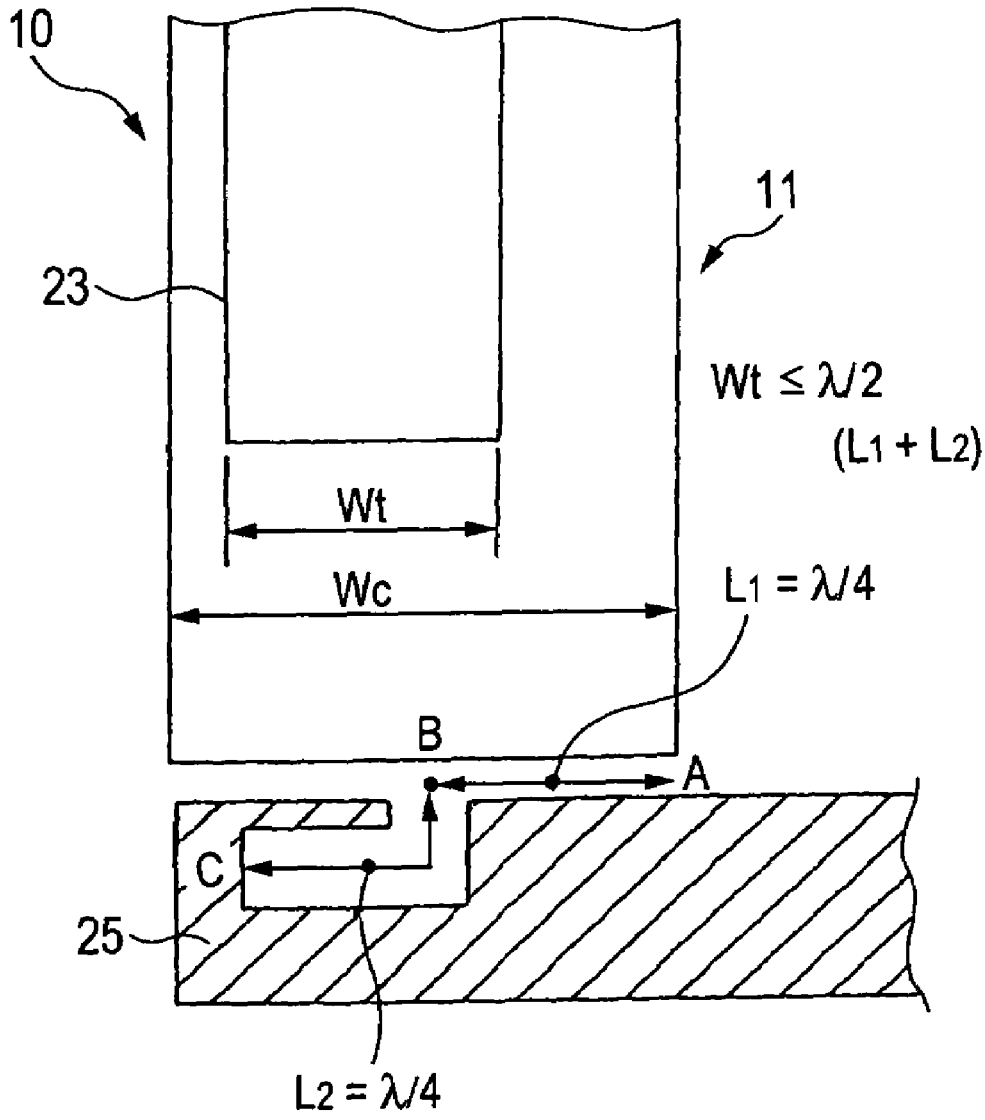
FIG. 17 is a horizontal sectional view showing a choke groove of the opening/closing door.

Generally, in a high-frequency heating apparatus, a groove called a choke groove is formed on the side of an/a opening/closing door so that no leakage of a radio wave is caused between the opening/closing door and a body case. FIG. 17 is a horizontal sectional view showing such a choke groove of the opening/closing door. As a magnetic field becomes zero at a point B apart by a quarter wavelength when the groove from an entrance (a point A) at which the opening/closing door 25 and the body case are joined to a position (a point C) apart by a half wavelength (the wavelength $\lambda$ of a used high frequency: approximately 12 cm) is provided, a radio wave travels only in a direction of the choke groove in an electric field and as the electric field is reflected at the point C, no wave cannot be generated and the radio wave cannot travel forward. Actually, as there is no potential difference between the point A and the point C, a radio wave is sealed at the entrance and is prevented from leaking.

Therefore, the wall forming the heating chamber 11 of the heating apparatus 100 is required to be at least a half wavelength or more thick, however, for a request for reducing area in which the heating apparatus 100 is installed, the wall is designed so that the wall has thickness close to a half wavelength to thin it possibly. To house the water tank 23 in the thickness Wc of the wall, the thickness Wt of the water tank 23 itself is required to be at least a half wavelength or less. The wall of the heating apparatus 100 is not required to be particularly thickened to house the water tank 23 by setting the thickness Wt of the water tank 23 to a half wavelength or less as described above and the water tank can be more efficiently housed.

Figure 18:
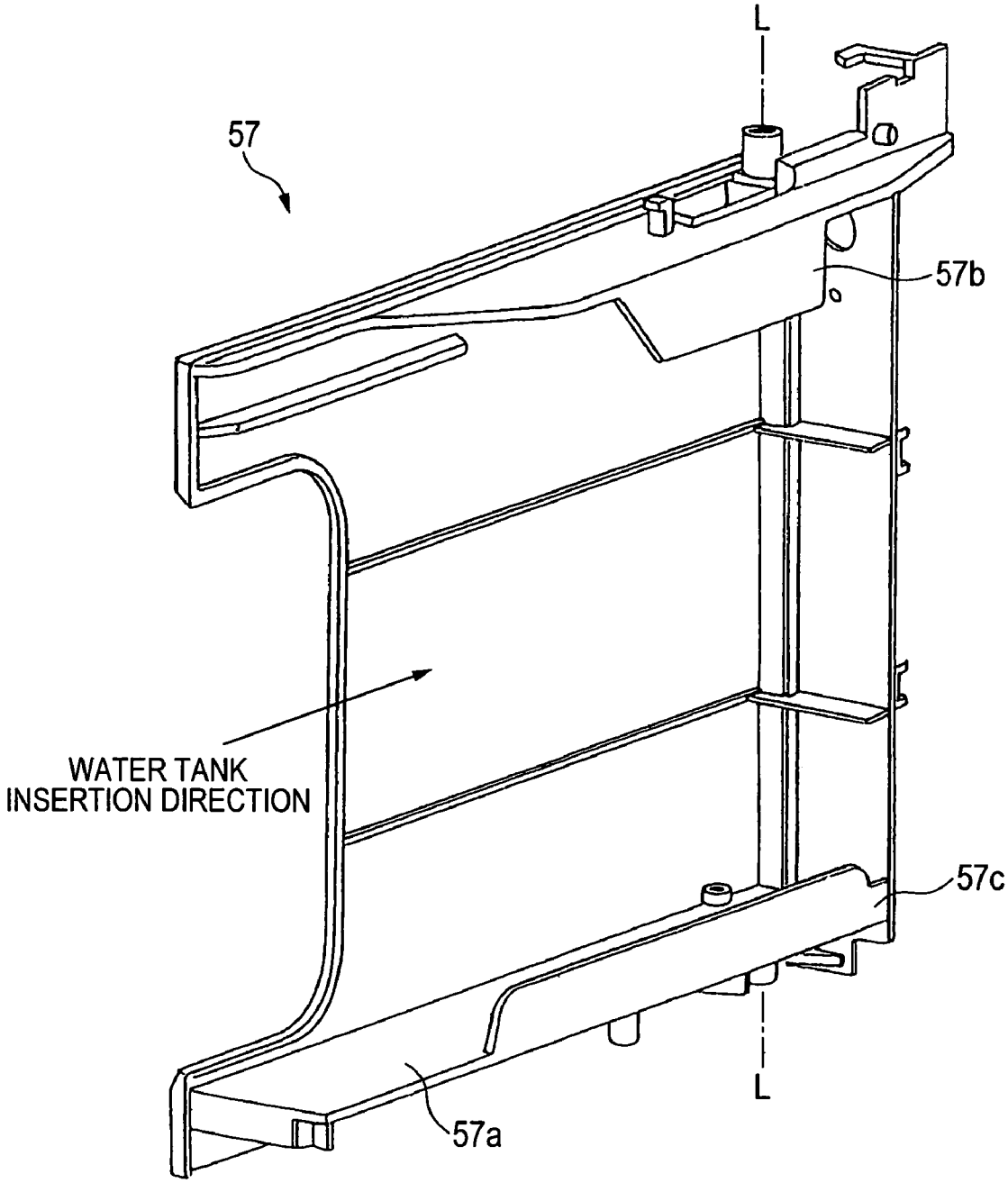
FIG. 18 is an enlarged perspective view showing a tank case door member.
Figure 19:
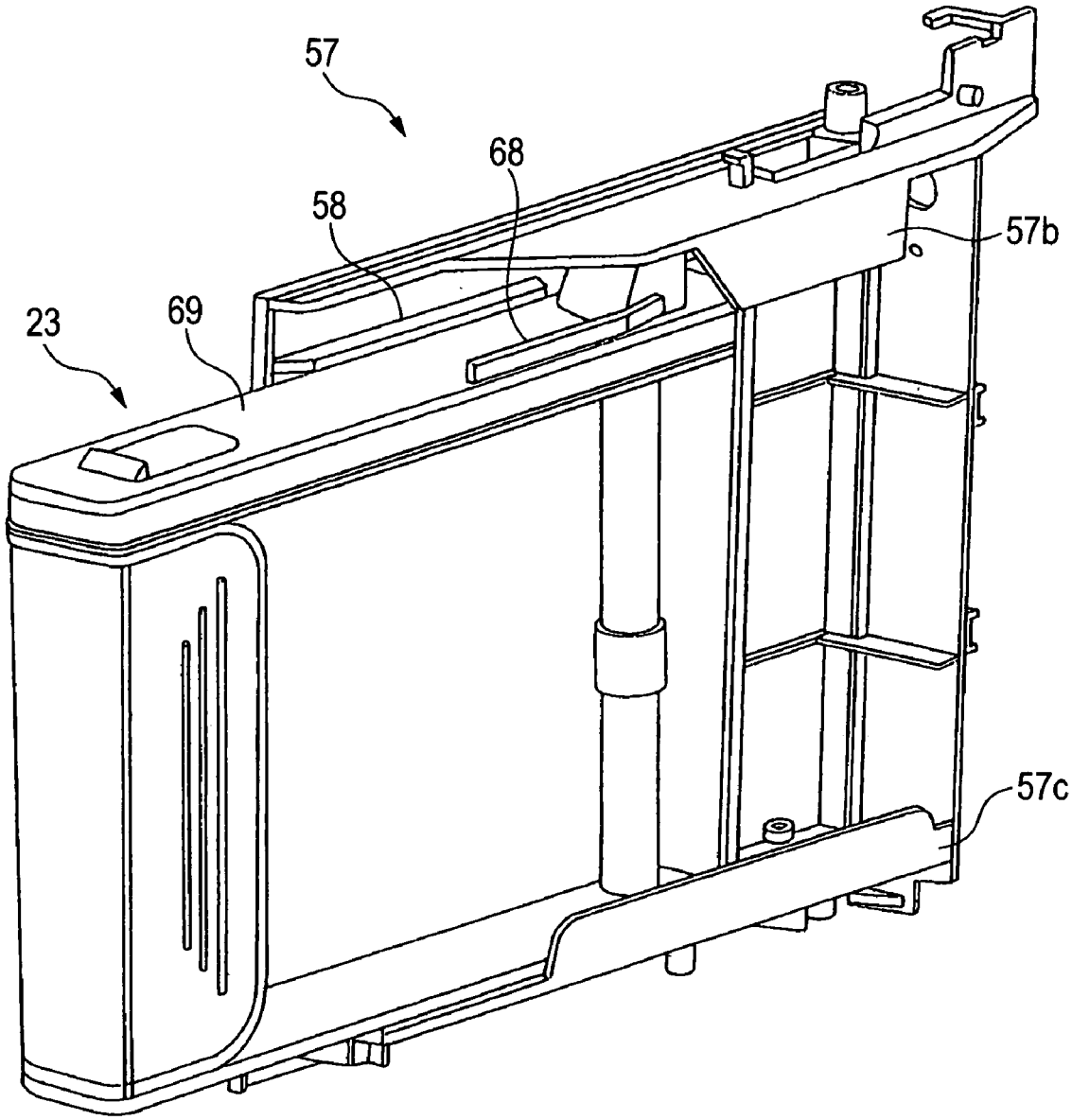
FIG. 19 is an explanatory drawing showing a state in which the water tank is inserted into the tank case door member shown in FIG. 18.

Even if the tank cap 69 is open by a half when the water tank 23 is attached to the heating apparatus 100, the tank cap 69 is automatically fitted to the body of the tank 63 by insertion. Referring to FIGS. 18 to 20, operation for fitting the tank cap 69 will be described below.

FIG. 18 is an enlarged perspective view showing the tank case door member, FIG. 19 is an explanatory drawing showing a state in which the water tank is being inserted into the tank case door member shown in FIG. 18 and FIG. 20 are explanatory drawings showing operation for fitting the tank cap 69 accompanied by the operation for inserting the water tank.

The tank case door member 57 shown in FIG. 18 covers an open face of the body of the tank case 53 (see FIG. 9) which is a flat rectangular parallelopiped one face of which is open and the water tank 23 is housed between the tank case door member and the body of the tank case 53. That is, the water tank 23 is laid at the bottom 57*a* of the tank case door member 57 and is housed by being inserted along an upper guide 57*b* and a lower guide 57*c* in a direction shown by an arrow in FIG. 18. The water tank 23 is positioned horizontally by being slid on a rib (a side guide) 58 protruded from the side of the tank case door member 57.

At this time, as shown in FIG. 19, the upper guide 57*b* of the tank case door member 57 regulates a position in which the water tank 23 is inserted because the upper guide is fitted to a guide for regulation 68 made of a plate stood on the upper surface of the tank cap 69 of the water tank 23. Referring to FIG. 20, the regulation will be described below. FIGS. 20A1, 20B1 and 20C1 are top views showing operation for inserting the water tank and operation for fitting the tank cap and FIGS. 20A2, 20B2 and 20C2 are side views in a direction in which the tank is inserted corresponding to the above drawings.

First, as shown in FIGS. 20A1 and 20A2, when the water tank 23 is inserted into the tank case door member 57 with the tank cap 69 open by a half, one end face of the tank cap 69 is slid along the rib 58. As shown in FIGS. 20B1 and 20B2, when the water tank 23 further continues being inserted, the guide for regulation 68 of the tank cap 69 begins to be touched to the upper guide 57*b* of the tank case door member 57 and the end face of the tank cap 69 is pressed on the rib 58. Hereby, the water tank 23 is positioned in a horizontal direction perpendicular to a direction in which the water tank is inserted. Next, as shown in FIGS. 20C1 and 20C2, when the guide for regulation 68 of the tank cap 69 continues being inserted, being slid on the upper guide 57*b* of the tank case door member 57, the lower surface of the upper guide 57*b* runs on the side 69*a* of the guide for regulation 68 of the tank cap 69, the tank cap 69 is fitted to the body of the tank 63 and is closed.

The water tank 23 is positioned in the direction perpendicular to the direction in which the water tank is inserted by the guide for regulation 68, the upper guide 57*b*, the side 69*a* and the rib 58 on the opposite side, is also vertically regulated and when the tank cap 69 is forgotten to be closed, it can be also securely closed by the operation for inserting the water tank 23.

As described above, the replacement of water is facilitated by arranging the water tank 23 so that it can be detached from the heating apparatus 100 and water can be sanitarily supplied. The arrangement of the water tank 23 on the side of the heating apparatus 100 has no effect upon heating operation from the front side of the heating apparatus 100, for operation for detaching the water tank 23, the tank case door member 57 is also opened on the front side by providing a rotating axis of the tank case door member 57 inside the heating apparatus 100 and operation for attachment or detachment satisfactory in operability from the front side is enabled.

The water tank 23 can be provided in any position of the side on the reverse side, the upper surface of the heating apparatus and the lower surface in addition to a case that the water tank is arranged on one side of the heating apparatus as described above. In that case, the operation for detachment satisfactory in operability is also enabled by extracting the water tank from the front side after the water tank 23 is pulled out outside the heating apparatus 100 from the wall.

The area in which the heating apparatus is installed is prevented from being increased without particularly enlarging the body size of the heating apparatus 100 by efficiently housing the water tank 23 in the wall of the heating apparatus 100.

Next, the second characteristic that the water tank 23 arranged close to the heating chamber is hardly influenced by heat from the heating chamber will be described.

To explain the characteristic, a member related to the housing of the water tank 23 will be described more detailedly below.

Figure 21:
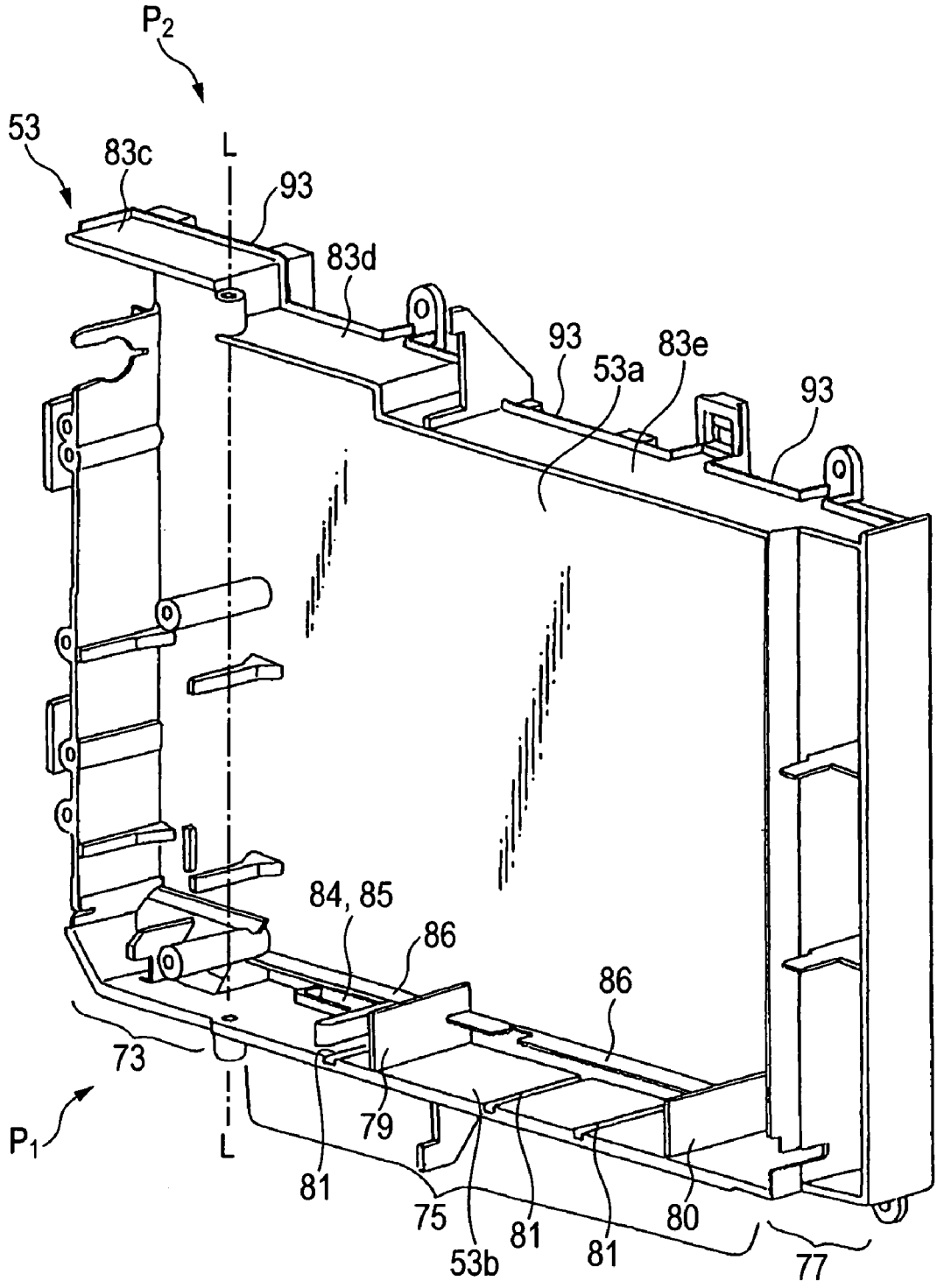
FIG. 21 is an enlarged perspective view showing the body of the tank case.
Figure 22:
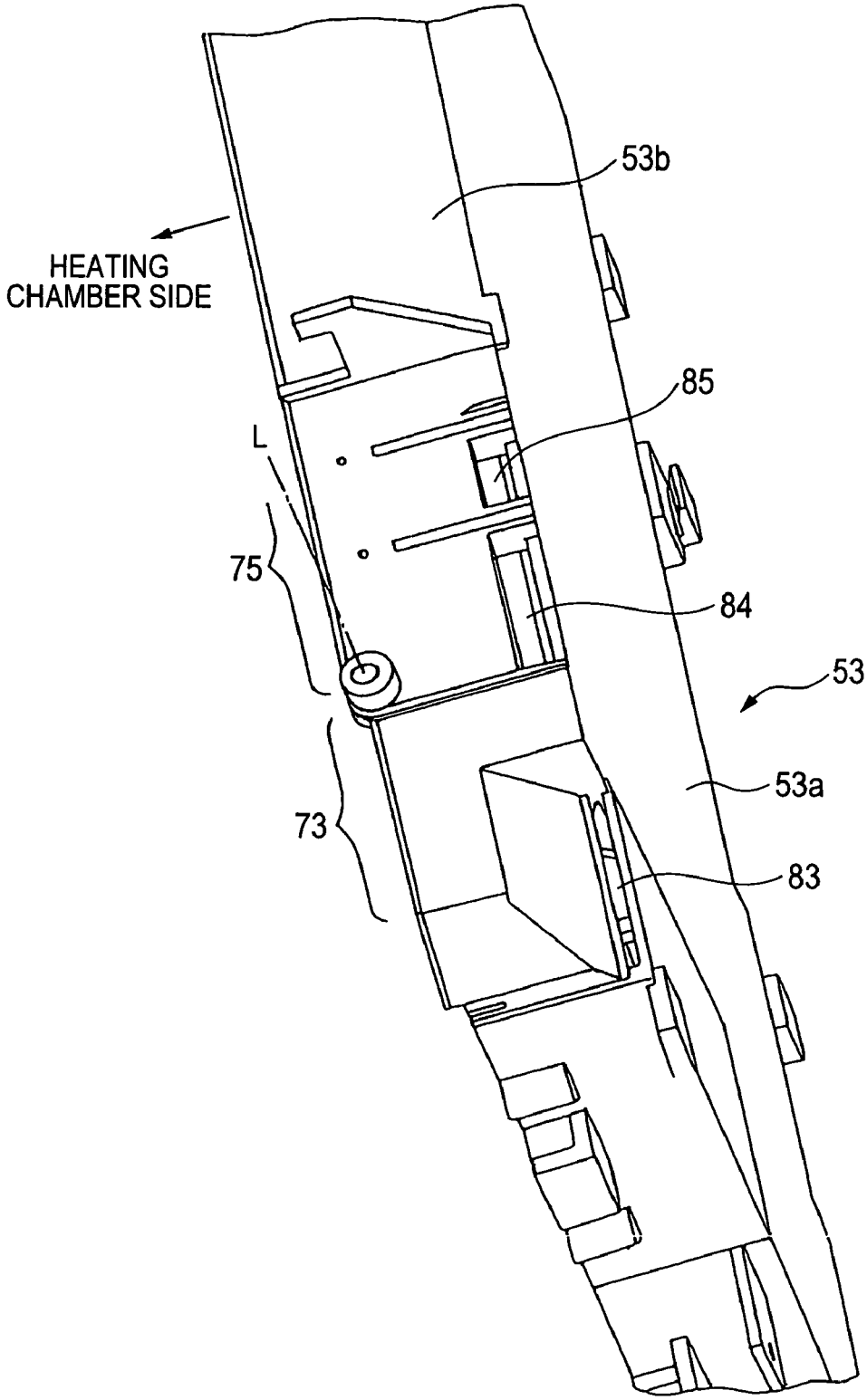
FIG. 22 is a view viewed from a direction shown by an arrow $P_1$ in FIG. 21.
Figure 23:
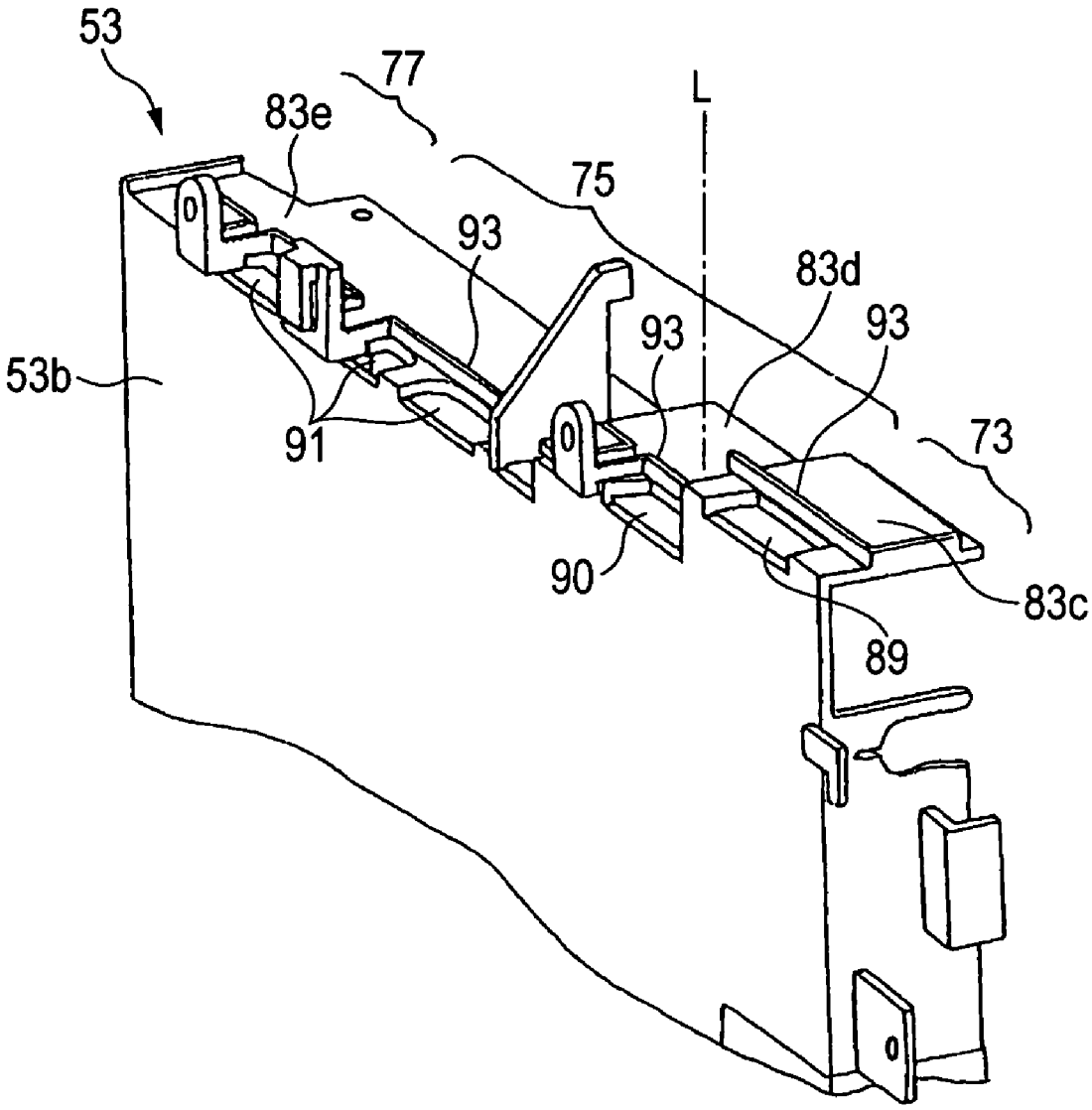
FIG. 23 is a view viewed from a direction shown by an arrow $P_2$ in FIG. 21.

FIG. 21 is an enlarged perspective view showing the body of the tank case, FIG. 22 is a view viewed from a direction shown by an arrow $P_1$ in FIG. 21 and FIG. 23 is a view viewed from a direction shown by an arrow $P_2$ in FIG. 21.

The body of the tank case 53 is in the shape of a box that one surface of a flat rectangular parallelopiped is open and is provided with a pump area 73 in which the pump 55 is housed, a water tank area 75 in which the water tank 23 is housed and a fitting member area 77 in which a fitting member for fitting the tank case door member 57 is housed. The surface 53*a* on the side to which the body of the tank case 53 is attached is screwed on the side heat insulating plate 51 (see FIG. 9) provided along the wall of the heating chamber of the heating apparatus 100 via predetermined space.

Protrusions 79 and 80 for partitioning the bottom 53*b* in the water tank area 75 are stood substantially vertically at the bottom 53*b* of the body of the tank case 53 and the bottom of the body of the tank case is provided with plural grooves for dewatering 81 formed from the side of the surface 53*a* on the side to which the bottom 53*b* is attached toward the side of the side end face on the reverse side. As shown in FIG. 22, in the pump area 73 of the bottom 53*b*, a lower opening 83 is provided and in the water tank area 75, lower openings 84 and 85 are also provided. On the upper side in FIG. 21 in a vertical direction of the lower openings 83, 84 and 85, a waterproofing protrusion 86 covering the lower opening 85 via clearance is protruded inside the body of the tank case 53 with the surface 53*a* on the attached side as a base. The waterproofing protrusion 86 is extended from a position over the lower openings 83, 84 and 85 to a position of the protrusion 80 via the protrusion 79.

In the meantime, as shown in FIG. 23, on the upside of the body of the tank case 53, an upper opening 89 is provided to the upper surface 83*c* of the pump area 73, an upper opening 90 is provided to the upper surface 83*d* of the water tank area 75 and an upper opening 91 is provided to an upper surface 83*e*. A rib for damming 93 is protruded at the edge on the reverse side of the surface 53*a* on the attached side of each upper opening 89, 90, 91 on the whole upper surface on which the upper openings 89, 90 and 91 are formed so that a water drop that adheres to the upper surfaces 83*c*, 83*d* and 83*e* is prevented from dropping inside the body of the tank case 53 via the upper openings 89, 90 and 91.

The tank case door member 57 shown in FIG. 18 is supported so that the door member can be turned by the rotating axis L of the body of the tank case 53.

Figure 24:
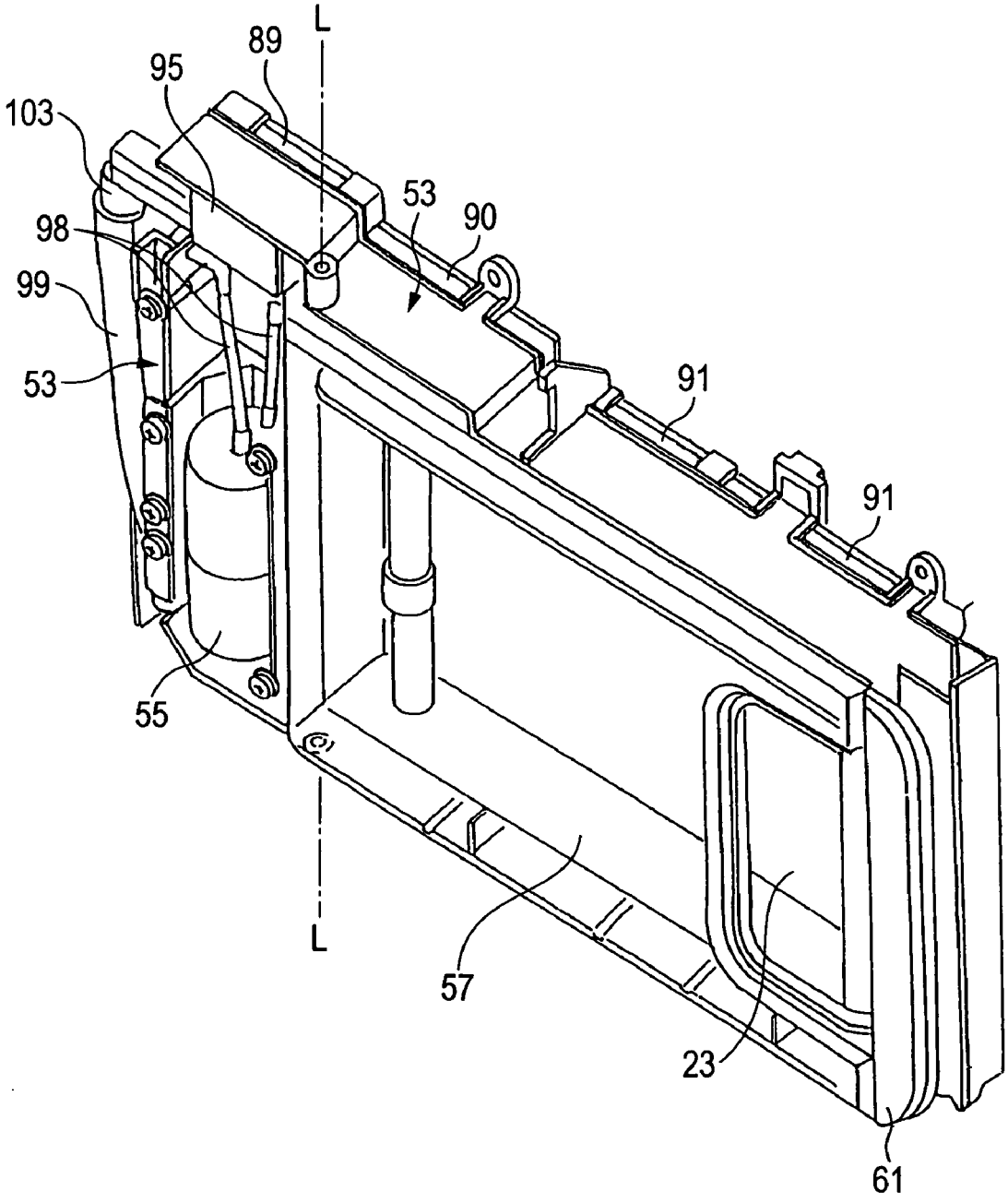
FIG. 24 is a perspective view showing configuration that the tank case door member is supported by a rotating axis of the body of the tank case and the water tank is housed between the body of the tank case and the tank case door member.
Figure 25:
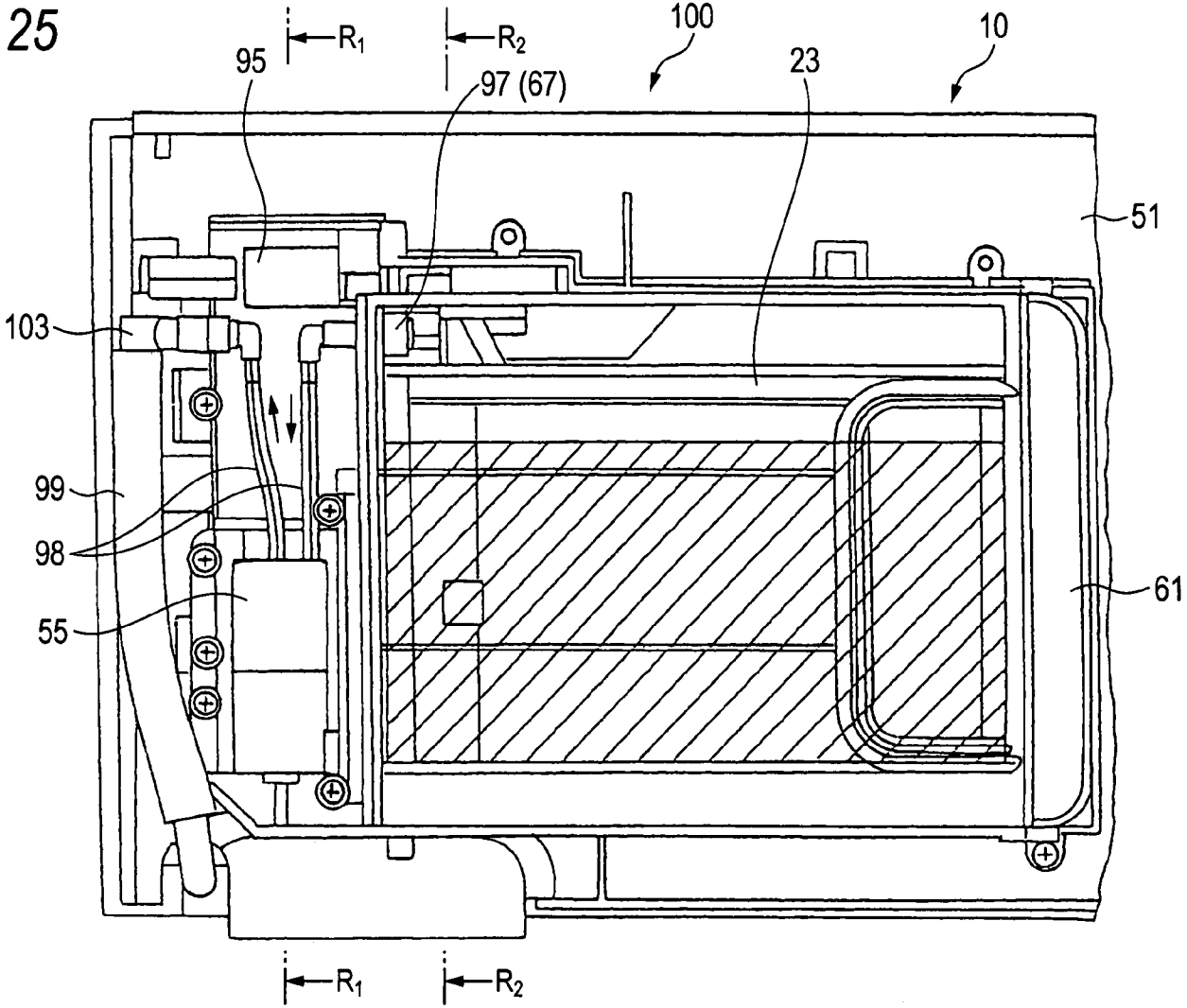
FIG. 25 is a side view showing a state in which an assembly shown in FIG. 24 is attached to a side heat insulating plate of the high-frequency heating apparatus.

FIG. 24 is a perspective view showing configuration that the tank case door member is supported by the rotating axis L of the body of he tank case and the water tank is housed between the body of the tank case and the tank case door member and FIG. 25 is a side view showing a state in which an assembly shown in FIG. 24 is attached to the side heat insulating plate of the high-frequency heating apparatus.

As shown in FIGS. 24 and 25, a detection switch 95 for detecting the attachment of the water tank and a joint 97 connected to the supply port 67 of the water tank 23 are attached to the body of the tank case 53. Water in the water tank 23 is sucked and discharged via a conveying pipe 98 by driving the pump 55 and is supplied by predetermined quantity to the evaporation pan at the bottom of the heating chamber via a conveying pipe having a large diameter 99. The conveying pipe having a large diameter 99 is set so that the inside diameter of the pipe is larger than that of the conveying pipe 98 so as to prevent water supplied by the pump 55 from remaining in the pipe by atmospheric pressure. Therefore, a water level in the conveying pipe 98 is equal to the height of a part 103 in which the conveying pipe 98 and the conveying pipe having a large diameter 99 are coupled, and water is prevented from naturally flowing out by the pressure of water in the water tank 23 without driving the pump 55.

Next, a method of cooling the water tank 23 will be described.

Figure 26:
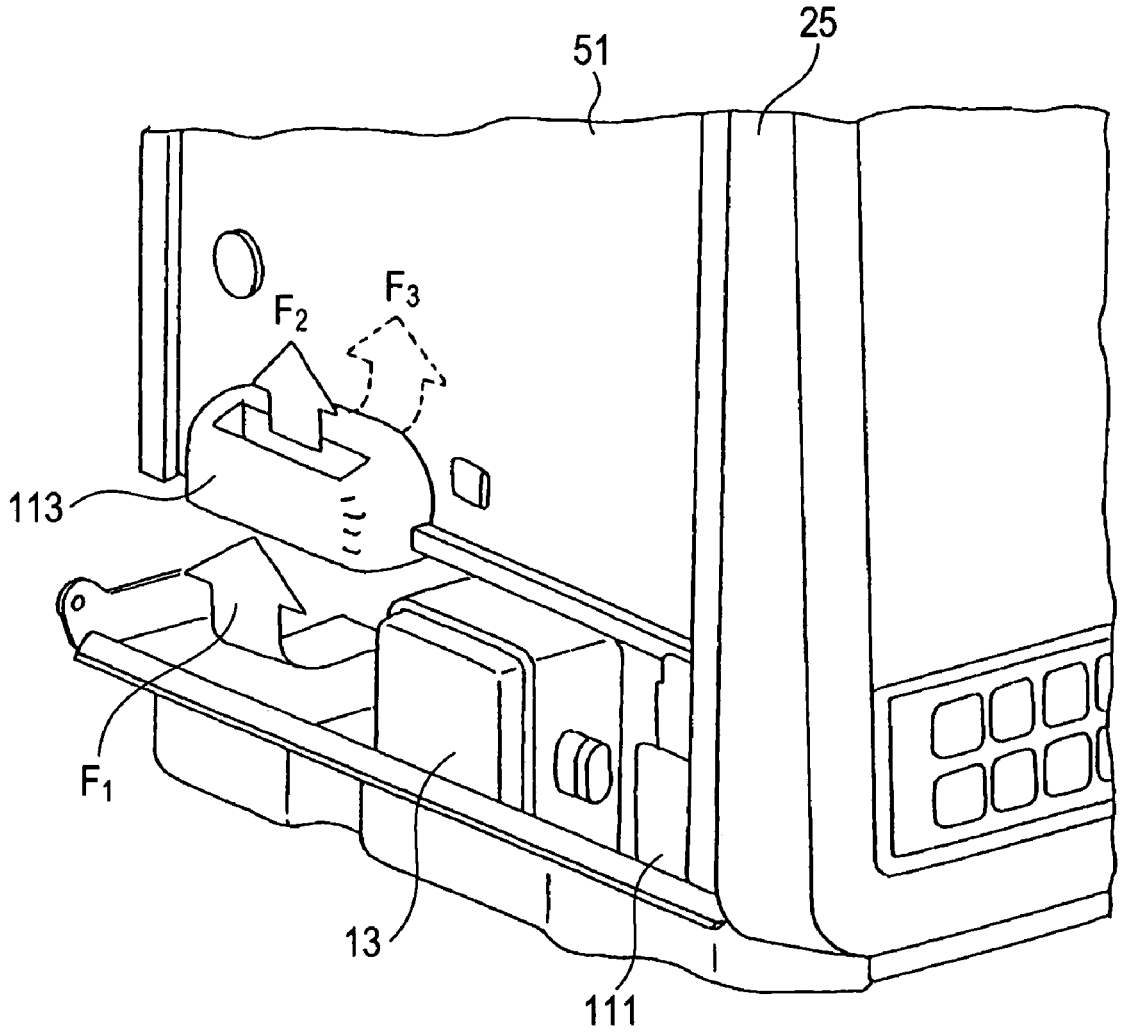
FIG. 26 is an explanatory drawing showing a state in which a blast from the downside of the heating chamber of the high-frequency heating apparatus is led on the side.
Figure 27:
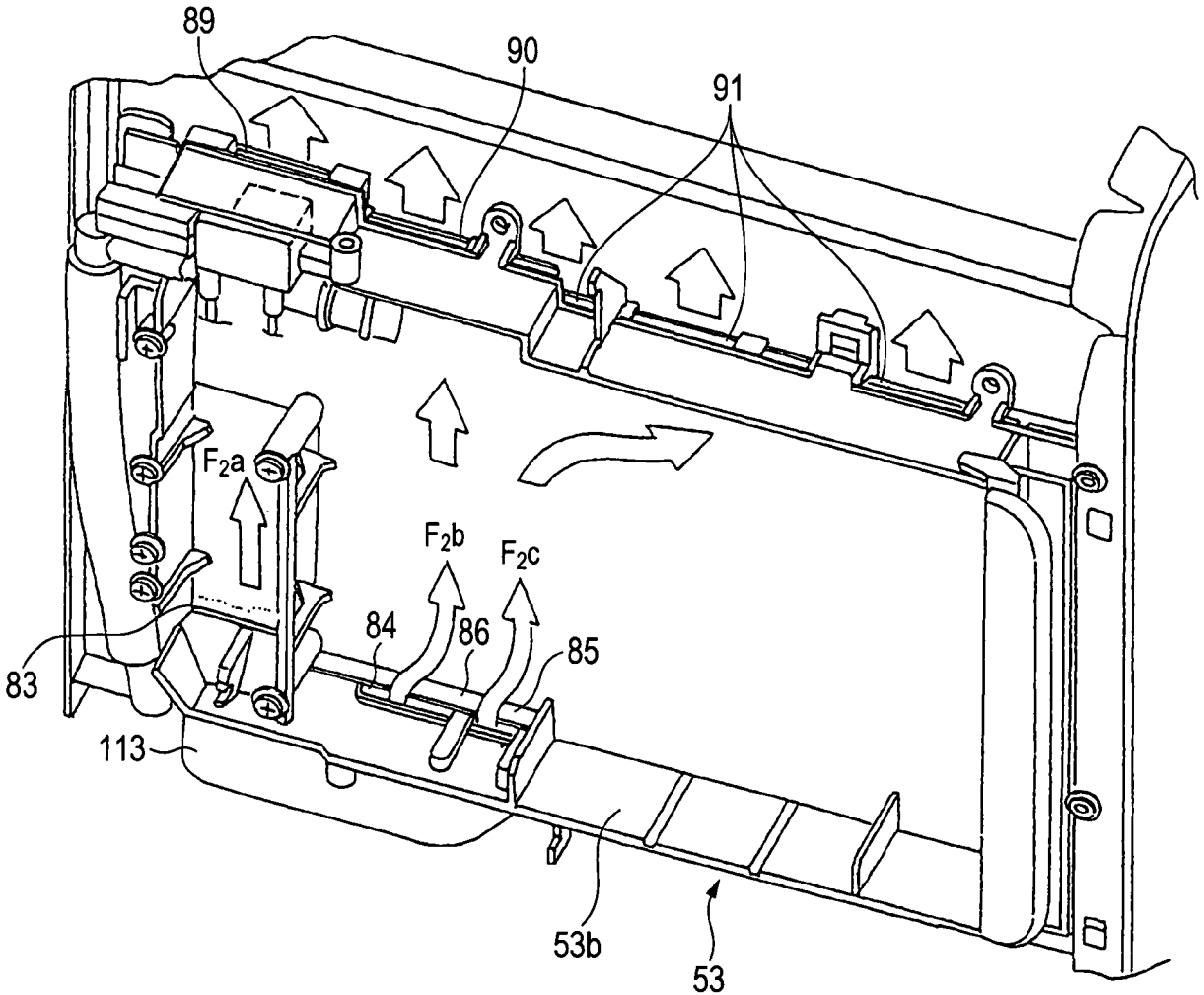
FIG. 27 is a perspective view schematically showing a path of wind sent by the body of the tank case.

FIG. 26 is an explanatory drawing showing a state in which a blast from the lower side of the heating chamber of the high-frequency heating apparatus is led out to the side and FIG. 27 is a perspective view schematically showing a path of wind sent by the body of the tank case.

Referring to FIGS. 26 and 27, the schematic path of a cooling wind in the periphery of the water tank 23 will be described below. As shown in FIG. 26, the control circuit in which electronic parts such as the magnetron 13 are arranged is mounted at the bottom of the high-frequency heating apparatus 100 and a cooling fan 111 for cooling these electronic parts is similarly arranged at the bottom. Wind sent from the cooling fan 111 flows from the side of the bottom to the side as shown by an arrow $F_1$ in FIG. 26 via a fin for cooling not shown of the magnetron 13. Wind from the cooling fan 111 is led upward by an orienting duct 113 the lower side fixed to the side heat insulating plate 51 of which is open. Though the details are described later, the orienting duct 113 supplies a part of led wind outside the side heat insulating plate 51 to which the body of the tank case 53 is attached as shown by an arrow $F_2$ and supplies other wind to clearance with a wall plate on the side of the heating chamber inside the side heat insulating plate 51 as shown by an arrow $F_3$.

Wind supplied outside the side heat insulating plate 51 by the orienting duct 113 and shown by the arrow $F_2$ is divided into $F_2b$, $F_2c$ and $F_2d$ by the lower openings 83, 84 and 85 of the body of the tank case 53 as shown in FIG. 27, is led inside the body of the tank case 53 and is exhausted from the upper openings 89, 90 and 91.

The wind shown by the arrow $F_2$ will be described further in detail below.

Figure 28:
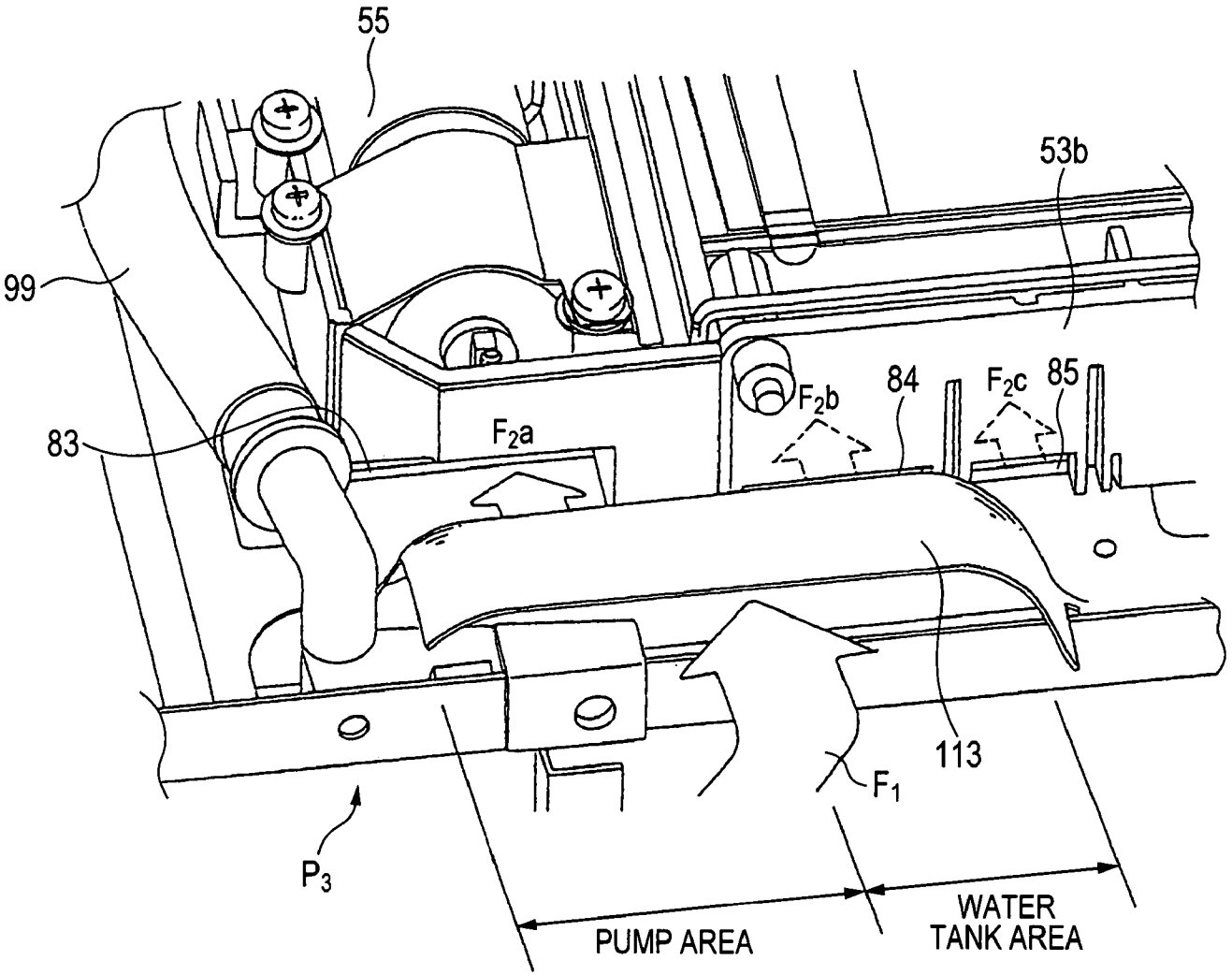
FIG. 28 is an enlarged perspective view showing a part of an orienting duct.
Figure 29:
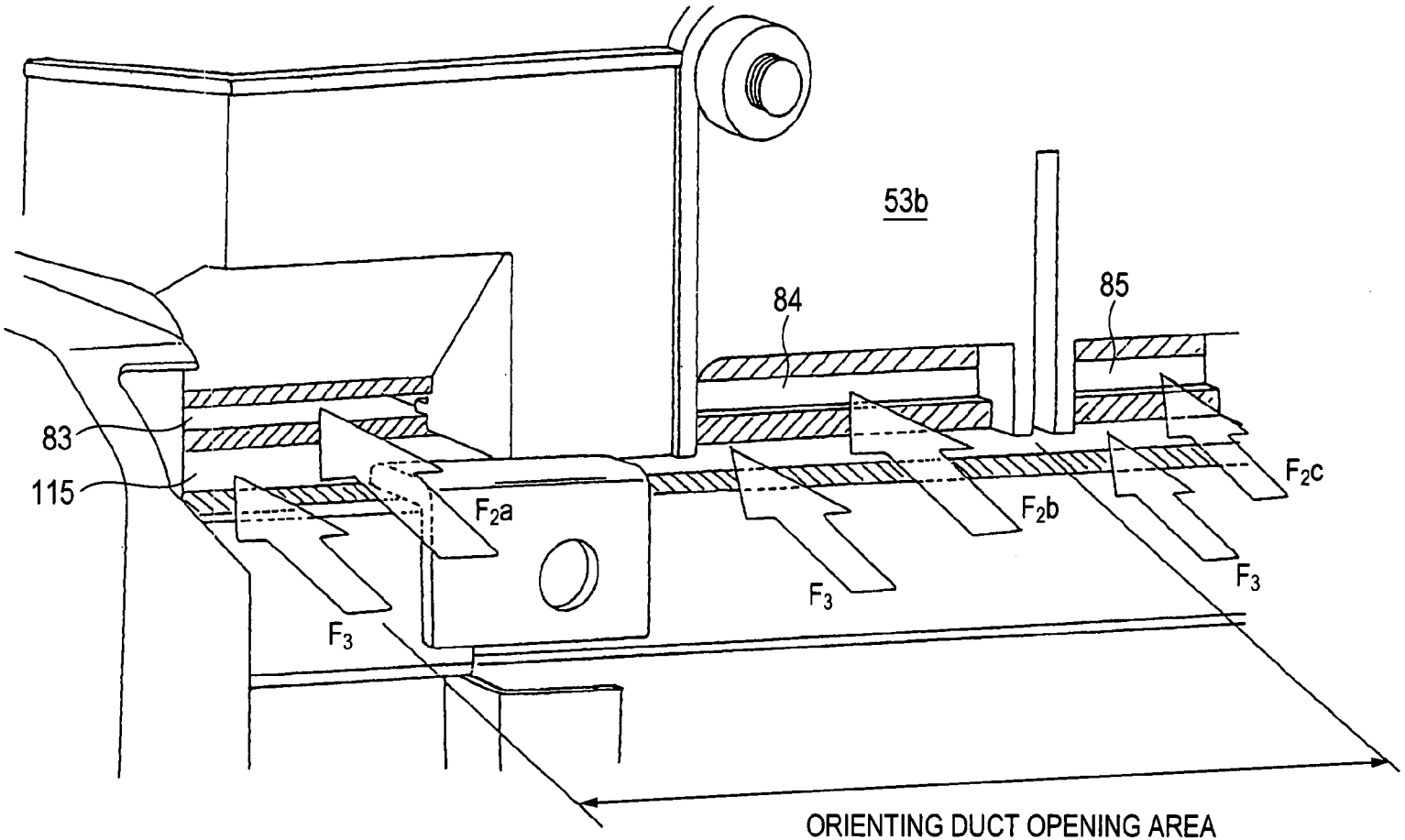
FIG. 29 is a view viewed from a direction shown by an arrow $P_3$ in FIG. 28 in which the orienting duct shown in FIG. 28 is omitted.

FIG. 28 is an enlarged perspective view showing a part of the orienting duct 113 and FIG. 29 is a view viewed from a direction shown by an arrow $P_3$ in which the orienting duct shown in FIG. 28 is omitted. As shown in FIG. 28, wind led into the orienting duct 113 and shown by the arrow $F_1$ is divided into wind supplied to the pump area via the lower opening 83 of the body of the tank case 53 and shown by the arrow $F_2a$ and wind supplied to the water tank area via the lower openings 84 and 85 and shown by the arrows $F_2b$ and $F_2c$. The quantity of each wind supplied to the pump area and the water tank area is set to a substantially equal value.

As shown in FIG. 29, each opening 115 of the side heat insulating plate 51 is formed in a direction in which the lower openings 83, 84 and 85 are arranged and wind shown by the arrow $F_3$ is supplied to clearance with the wall plate on the side of the heating chamber inside the side heat insulating plate 51 via each opening 115.

The flow of wind in the pump area and the water tank area and the action of thermal insulation in each area will be described below.

Figure 30:
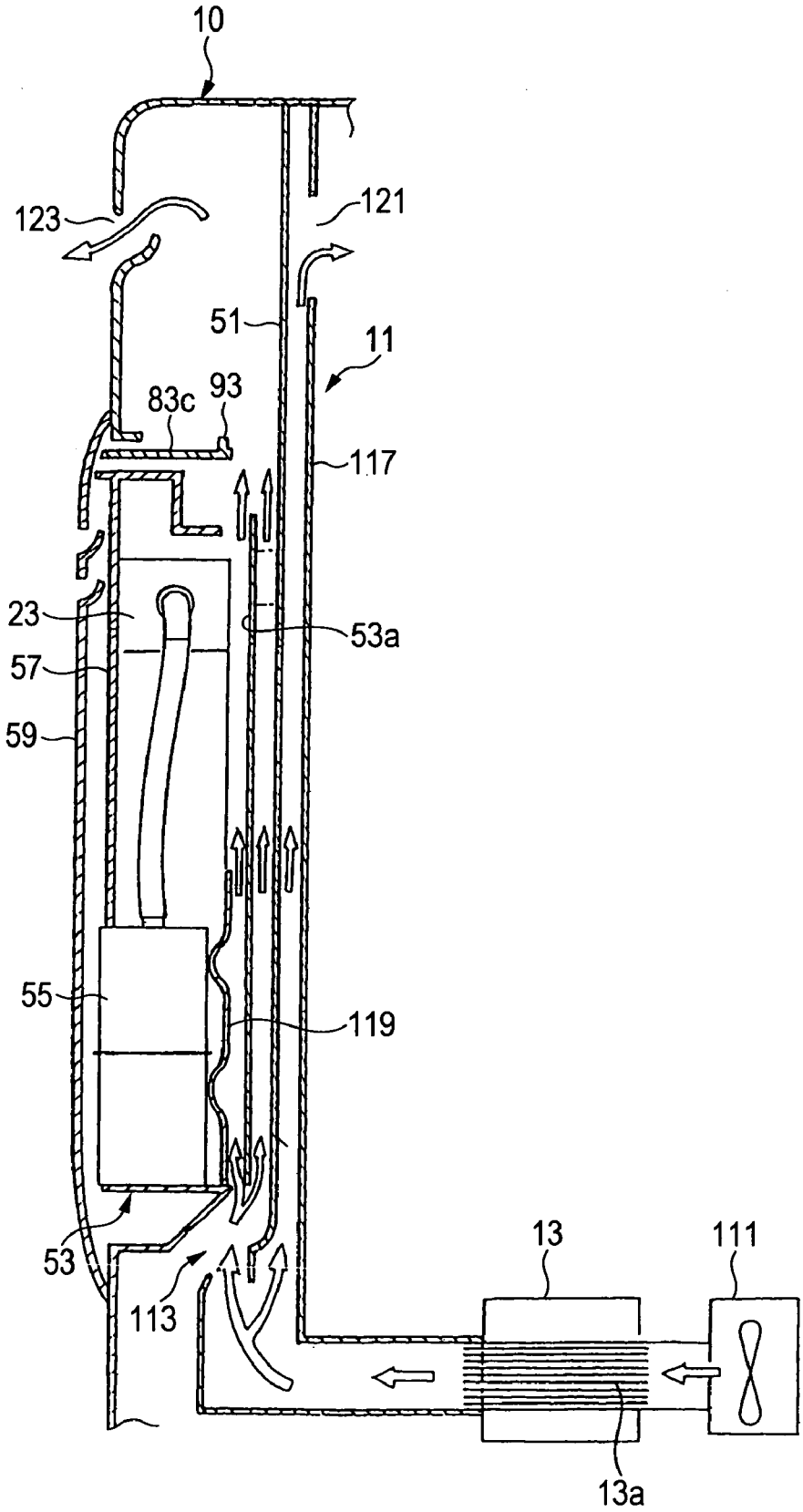
FIG. 30 is a sectional view showing a cross section viewed along a line $R_1$—$R_1$ in FIG. 25.
Figure 31:
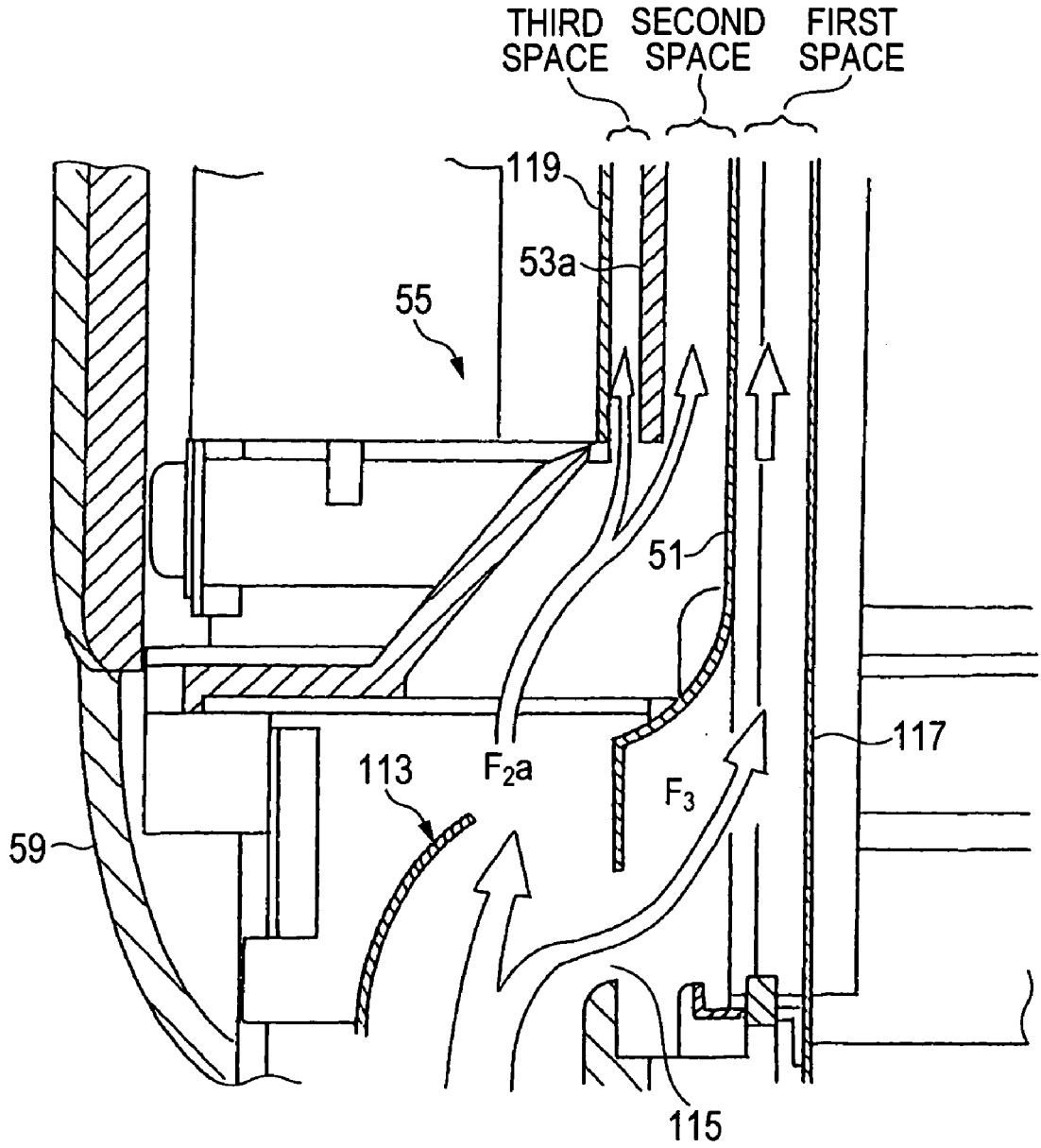
FIG. 31 is an enlarged view showing a part in FIG. 30.
Figure 32:
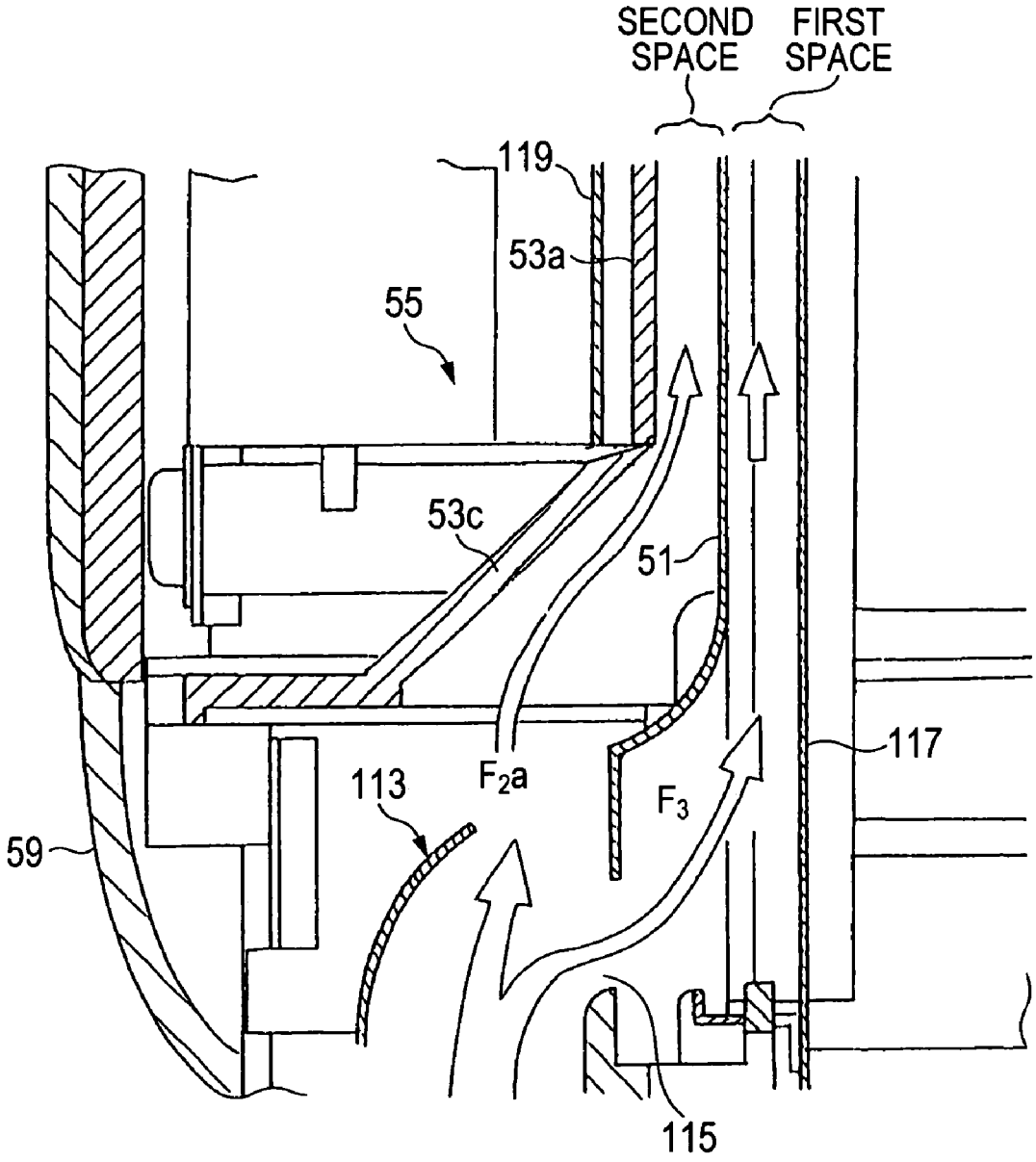
FIG. 32 is a sectional view showing configuration in case an inclined slope on the downside of the body of the tank case is extended.
Figure 33:
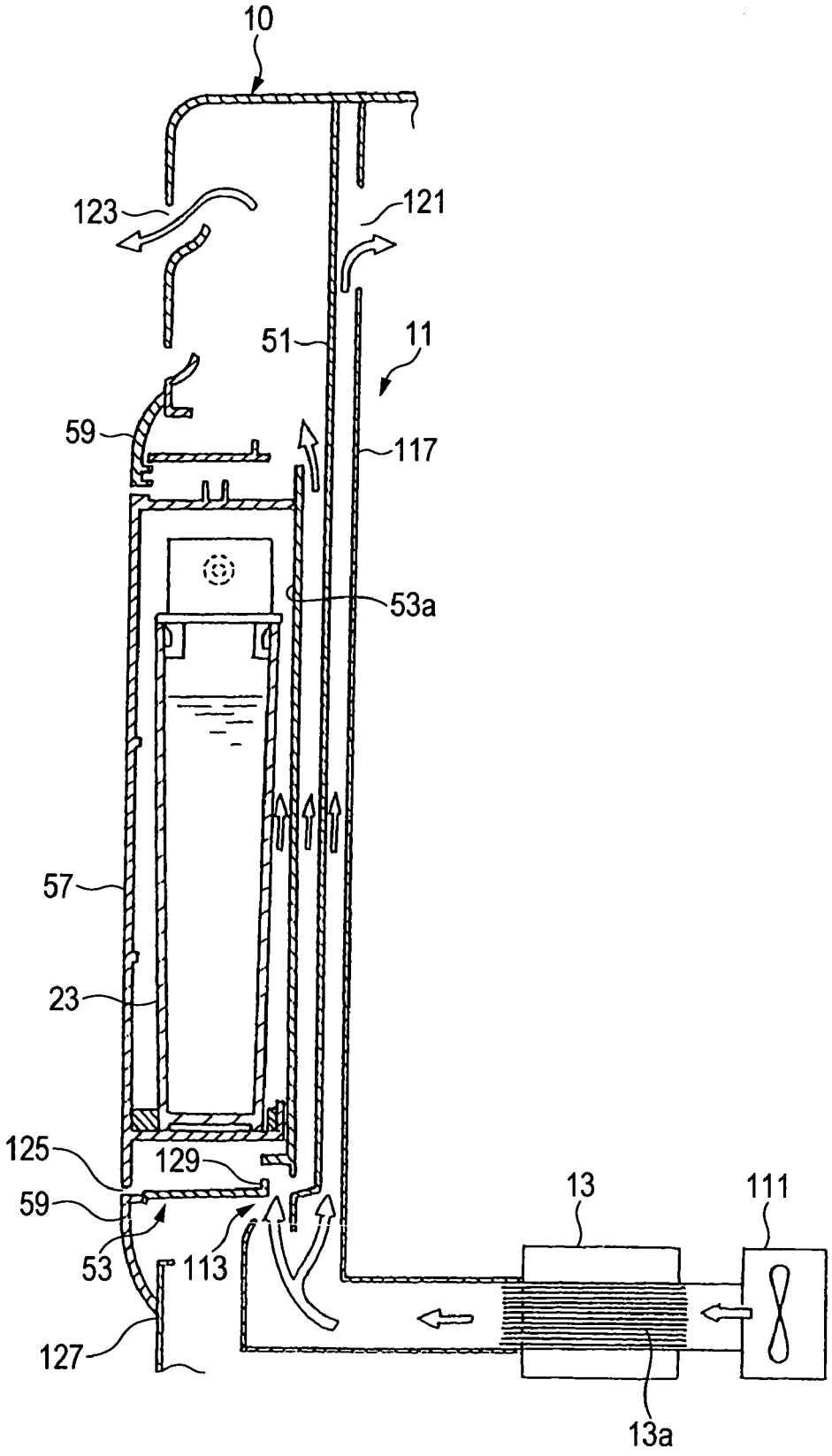
FIG. 33 is a sectional view showing a cross section viewed along a line $R_2$—$R_2$ in FIG. 25.
Figure 34:
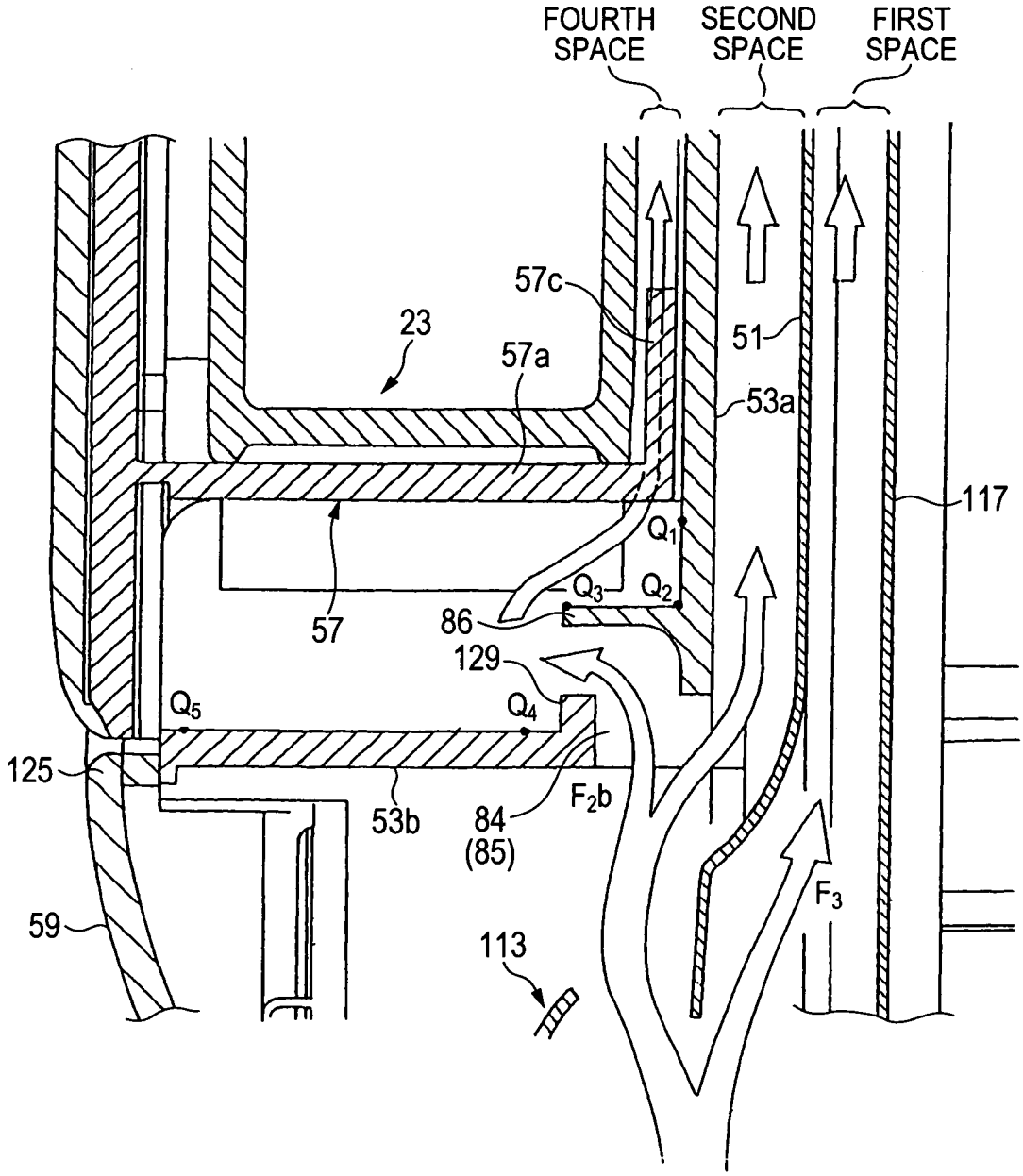
FIG. 34 is an enlarged view showing the part in FIG. 30.

FIG. 30 is a sectional view viewed along a line $R_1$—$R_1$ in FIG. 25, FIG. 31 is an enlarged view showing a part in FIG. 30 is enlarged, FIG. 32 is a sectional view showing configuration that an inclined slope on the downside of the body of the tank case is extended, FIG. 33 is a sectional view viewed along a line $R_2$—$R_2$ in FIG. 25 and FIG. 34 is an enlarged view showing a part in FIG. 33.

First, for the pump area, the pump 55 is particularly weak in heat, when the pump is not operated, the critical temperature is 70° C. and when the pump is operated, the critical temperature is 65° C. However, in case the heating chamber of the high-frequency heating apparatus 100 is heated approximately at 250° C. by the convection heater, the temperature of the pump area rises up to approximately 80 to 90° C. The water tank area is also similar and as the water tank itself is made of resin such as plastic, it may be deformed when it is exposed to a high-temperature atmosphere.

Then, in the configuration of the high-frequency heating apparatus 100 according to the invention, plural airy layers are formed between the pump 55 and the wall plate 117 on the side of the heating chamber and between the water tank 23 and the wall plate 117 on the side of the heating chamber, and heat from the side of the heating chamber 11 in heating by the convection heater 19 is possibly prevented from being transmitted to the side of the pump 55 and the side of the water tank 23 by ventilating the airy layers by the cooling fan.

Concretely, as shown in FIG. 30, a blast from the cooling fan 111 for cooling the magnetron 13 arranged at the bottom of the high-frequency heating apparatus 100 passes the heat sink 13*a* of the magnetron 13, converts the direction of the flow upward under the orienting duct 113 and is directed to the orienting duct 113. In the orienting duct 113, as enlarged in FIG. 31, led wind is supplied to clearance (first space) between the side heat insulating plate 51 and the wall plate 117 on the side of the heating chamber and clearance (second space) between the side heat insulating plate and the surface 53*a* on the attached side of the body of the tank case 53. Further, wind is also supplied to clearance (third space) between the surface and a heat insulating plate for the pump 119 provided between the surface 53*a* on the attached side of the body of the tank case 53 and the pump 55. The heat insulating plate for the pump 119 is made of a metal plate and shields the pump from heat radiated from the side of the heating chamber.

As described above, the wall plate 117 on the side of the heating chamber, the side heat insulating plate 51, the surface 53*a* on the attached side of the body of the tank case 53 and the heat insulating plate for the pump 119 are cooled by forming first, second and third spaces between the pump 55 and the wall plate 117 on the side of the heating chamber and ventilating these spaces, and air is prevented from remaining in each space. Hereby, the effect of thermal insulation by each space is enhanced and as a result, the rise of the temperature of the pump 55 by heat from the side of the heating chamber 11 can be inhibited. It is verified that when the heating chamber 11 is actually heated at approximately 250° C. by the convection heater, the temperature of the pump area becomes approximately 63° C. and the rise of temperature is inhibited up to the operating limit temperature of the pump 55 or lower.

In the meantime, in high-frequency heating, the heating chamber 11 itself does not particularly become high temperature because of a characteristic of a heating method and heat from the wall plate 117 on the side of the heating chamber does not make the temperature of the pump 55 greatly rise. However, in case the high output-type magnetron 13 is used, the temperature of the magnetron 13 itself greatly rises because the output is large, wind passing the heat sink 13*a* becomes high temperature and when this wind blows on the pump 55, the temperature of the pump 55 may exceed the critical temperature. Then, in case such a high output-type magnetron 13 is used, the third space is closed by extending an inclined slope 53*c* on the downside of the body of the tank case 53 as shown in FIG. 32. Hereby, the pump 55 and the heat insulating plate for the pump 119 are not directly exposed to wind and the temperature of the pump 55 is prevented from rising.

Wind that flows in the first space flows into the heating chamber 11 via an opening 121 (see FIG. 2) of the wall plate 117 on the side of the heating chamber to be wind for ventilating the heating chamber 11. Wind that flows in the second space is exhausted from an air vent 123 (see FIG. 1) of the high-frequency heating apparatus 100 (in case wind flows in the third space, the wind meets the wind in the second space over the body of the tank case 53) and a part is exhausted from an air vent (not shown) provided to the back side of the high-frequency heating apparatus 100.

To explain the water tank area, as shown in FIGS. 33 and 34, the water tank area is basically similar to the pump area, clearance (first space) between the wall plate 117 on the side of the heating chamber and the side heat insulating plate 51, clearance (second space) between the side heat insulating plate 51 and the surface 53*a* on the attached side of the body of the tank case 53 and clearance (fourth space) between the surface 53*a* on the attached side and the water tank 23 are formed, and the rise of the temperature of the water tank 23 and the periphery is inhibited by wind supplied to each space as described above.

The orienting duct 113 for leading wind sent from the cooling fan 111 to the side of the high-frequency heating apparatus 100 is provided in one location in a direction of the inside of the side of the high-frequency heating apparatus 100 in an area including the downside of a position in which the pump 55 is arranged. Hereby, wind that flows on the side of the water tank 23 is collectively supplied and the wind gains vigor. Therefore, wind can efficiently blow, compared with a case that wind is supplied on average in a direction of the inside and the stagnation of wind can be eliminated.

Next, the third characteristic that a waterproofing measure to prevent the high-frequency heating apparatus from being influenced by leakage is taken will be described.

As the control circuit is arranged at the bottom of the high-frequency heating apparatus 100 in case water leaks from the water tank 23, water is required to be prevented from entering the control circuit. Therefore, first, when the water tank 23 is attached to the high-frequency heating apparatus 100, the tank case covering the periphery of the water tank 23 is housed in the wall of the high-frequency heating apparatus 100. This tank case is composed of the body of the tank case 53 and the tank case door member 57 as described above. Water can be prevented from leaking directly into the body from the water tank 23 by covering the water tank 23 with the tank case and a range of leakage is prevented from being extended by the force of water.

Second, a measure for the bottom 53*b* of the body of the tank case 53 against water leakage from the water tank 23 is taken. As shown in FIGS. 21 and 34, water dropping through the tank case door member 57 from the side of the water tank 23 is prevented from directly dropping at the lower opening 84 as it is by the waterproofing protrusion 86 over the lower opening 84 (85 is also similar) on the side of the water tank 23 at the bottom 53*b* of the body of the tank case 53. That is, a leak from $Q_1$ in FIG. 34 is once received at $Q_2$, flows to $Q_3$, drops at $Q_4$ and flows in a direction of $Q_5$. Water toward $Q_5$ flows outside the door frame 59 from a part 125 bonded to the door frame 59 as shown in FIG. 33 or drops through clearance 127 on the downside of the door frame 59 and flows outside the body. Therefore, a leak from the water tank 23 never drops on the side of the control circuit via the lower opening 84.

As shown in FIGS. 21 and 34, a rib 129 is protruded from the bottom 53*b* of the body of the tank case 53 to prevent water dropping on the bottom 53*b* from dropping on the lower openings 84 and 85. Hereby, water flowing on the bottom 53*b* is prevented from flowing into the lower openings 84 and 85.

Further, the groove 81 for dewatering formed toward the side end face on the reverse side to the side of the heating chamber of the body of the tank case 53 is provided to the bottom 53*b* of the body of the tank case 53. Hereby, a water drop is prevented from remaining at the bottom 53*b* of the body of the tank case 53, a water drop on the bottom 53*b* smoothly moves and drops.

The protrusions stood from the bottom 53*b* of the body of the tank case 53 for partitioning the bottom 53*b* are provided. Hereby, a water drop on the bottom 53*b* can be prevented from moving to another partitioned area on the bottom 53*b* and even if there is a leak, the whole bottom 53*b* can be prevented from being dipped in water.

Third, a waterproofing measure against dew formation from the upper openings 89, 90 and 91 on the upper surface of the body of the tank case 53 is taken. Warm air and air including much moisture flow in the periphery of the body of the tank case 53 depending upon the contents of heating in the high-frequency heating apparatus 100. At this time, moisture in air is condensed in the body of the tank case 53 and a water drop may drop inside the body of the tank case 53 via the upper openings 89, 90 and 91. Therefore, as shown in FIG. 23, the continuous rib 93 is formed in a direction in which the upper openings 89, 90 and 91 are extended. A water drop condensed on the upper surface of the body of the tank case 53 is prevented from directly flowing via the upper openings 89, 90 and 91 by the rib 93.

INDUSTRIAL APPLICABILITY

As described above in detail, according to the high-frequency heating apparatus according to the invention, though the high-frequency heating apparatus has simple configuration, leakage into the apparatus from the water tank is prevented without large-sizing the apparatus, the apparatus is not influenced by heat from the heating chamber and the apparatus can have the sanitary configuration with ease of use.

The invention claimed is:

1. A high-frequency heating apparatus that supplies at least either a high frequency or steam to a heating chamber to heat an object to be heated, comprising:

a high frequency generator that supplies the high frequency to the heating chamber in which the object is accommodated;

a steam generator that supplies steam to the heating chamber;

a door provided in a wall of said apparatus; and a water tank for supplying water to the steam generator, said water tank being detachably arranged with said door such that said water tank is held within said door and such that, when said door is closed, said water tank is held within said wall of said apparatus and said door is flush with said wall of said apparatus, and wherein said water tank is detached from said apparatus by rotating said door away from said wall and then pulling said tank away from said door.

2. A high-frequency heating apparatus according to claim 1, wherein the maximum thickness of the water tank is thickness equivalent to a half wavelength or less of a supplied high frequency.

3. A high-frequency heating apparatus according to claim 1, wherein at least a part of a side of the water tank is made of material that transmits light.

4. A high-frequency heating apparatus according to claim 3, wherein a fluorescent back plate is provided opposite to the surface on the side of the heating chamber of the water tank in a state in which the water tank is attached to the high-frequency heating apparatus.

5. A high-frequency heating apparatus according to claim 4, wherein a scale showing a level of water in the water tank is formed on the back plate.

6. A high-frequency heating apparatus according to claim 3, wherein a scale showing a level of water is provided to the water tank.

7. A high-frequency heating apparatus according to claim 3, wherein a reflector that displays a level of water in the water tank on the front side of the high-frequency heating apparatus is protruded from the outside face of the water tank.

8. A high-frequency heating apparatus according to claim 7, wherein the reflector is a triangular prism.

9. A high-frequency heating apparatus according to claim 7, wherein the reflector is a mirror the reflecting surface of which is inclined on the side of the water tank.

10. A high-frequency heating apparatus according to claim 1, further comprising a tank case covering the periphery of the water tank in the wall.

11. A high-frequency heating apparatus according to claim 10, wherein said tank case comprises:

a body of the tank case fixed on the side of the high-frequency heating apparatus, wherein said door is movably supported by an axis of the body of the tank case so that the door can be opened, the water tank being housed between the door and the body of the tank case; and door fitting means for fitting the door to the body of the tank case and holding the door in a closed state.

12. A high-frequency heating apparatus according to claim 11, wherein the tank case door member is pulled out on the front side of the high-frequency heating apparatus by arranging the water tank on either side of the high-frequency heating apparatus and providing the axis on the rear side of the side of the high-frequency heating apparatus.

13. A high-frequency heating apparatus according to claim 11, wherein the door fitting means releases the fitting of the tank case door member when the door fitting means is pressed inside the high-frequency heating apparatus in a state in which the tank case door member is closed; and the door fitting means fits the tank case door member in a closed state when the tank case door member is pushed back inside the high-frequency heating apparatus in a state in which the tank case door member is open.

14. A high-frequency heating apparatus according to claim 11, wherein a pump for supplying water to the steam generator from the water tank is arranged in the body of the tank case; and a heat insulating plate for the pump is provided between the pump and the body of the tank case on the side of the heating chamber.

15. A high-frequency heating apparatus that supplies at least either a high frequency or steam to a heating chamber to heat an object to be heated, comprising:

a high frequency generator that supplies the high frequency to the heating chamber in which the object is accommodated;

a steam generator that supplies steam to the heating chamber;

a water tank for supplying water to the steam generator, said water tank being detachably arranged with an outside face of the high-frequency heating apparatus; and a tank case covering the periphery of the water tank in the wall, wherein a side heat insulating plate is fixed via first space outside a side wall plate of the heating chamber;

further, the tank case is fixed via second space outside the side heat insulating plate; and a blower that supplies wind to at least the first space and the second space is provided.

16. A high-frequency heating apparatus according to claim 15, wherein the tank case comprises:

a body of the tank case fixed to the side of the high-frequency heating apparatus;

a tank case door member movably supported by an axis of the body of the tank case so that the tank case door member can be opened or closed, a water tank being housed between the body of the tank case and the tank case door member; and door fitting means for fitting the tank case door member to the body of the tank case and holding it in a closed state, wherein the second space is space between the side heat insulating plate and the body of the tank case; and further, wind from the blower is supplied to third space formed between the body of the tank case and the heat insulating plate for the pump.

17. A high-frequency heating apparatus according to claim 16, wherein wind from the blower is supplied to fourth space formed between the body of the tank case and the water tank.

18. A high-frequency heating apparatus according to claim 15, wherein the blower is a cooling fan for cooling a magnetron in a high-frequency heating part.

19. A high-frequency heating apparatus according to claim 15, wherein the blower is arranged on the downside of a heating chamber of the high-frequency heating apparatus; and a duct blasthole for leading wind sent from the blower to the side of the high-frequency heating apparatus is provided in a one-sided location in a direction of the depth of the side in an area including at least the downside of a position in which the pump is arranged.

20. A high-frequency heating apparatus according to any of claims 16 to 19, wherein an opening for ventilation vertically open is formed on the side of the heating chamber of the bottom of the body of the tank case; and a drip-proofing protrusion covering the opening via clearance in a vertical direction is protruded inside the tank case on a vertical wall on the side of the heating chamber in the vicinity of the bottom of the body of the tank case.

21. A high-frequency heating apparatus according to claim 11 or 15, wherein a groove for dewatering formed toward a side end face on the reverse side to the vertical wall on the side of the heating chamber of the body of the tank case is provided at the bottom of the body of the tank case.

22. A high-frequency heating apparatus according to claim 11 or 15, said tank case further comprising: a rib standing from the bottom of the body of the tank case for partitioning the bottom.

23. A high-frequency heating apparatus that supplies at least either a high frequency or steam to a heating chamber to heat an object to be heated comprising:

a high frequency generator that supplies the high frequency to the heating chamber in which the object is accommodated;

a steam generator that supplies steam to the heating chamber;

a water tank for supplying water to the steam generator, said water tank being detachably arranged with an outside face of the high-frequency heating apparatus;

a plate guide for regulation stood in a direction in which the water tank is inserted on the upper surface of the water tank; and a side guide extended in the direction in which the water tank is inserted on one side of the water tank and touched to the side of the water tank and a flat upper guide hanging from the upside of the water tank and touched to a face on the reverse side to the side guide of the guide for regulation respectively provided on the side of the high-frequency heating apparatus that houses the water tank, wherein the upper guide is slid on the guide for regulation when the water tank is inserted along the side guide.

24. A high-frequency heating apparatus according to claim 23, wherein the upper guide hangs up to a position of the upper surface of the water tank.

25. A high-frequency heating apparatus comprising:

a high frequency generator that supplies a high frequency electromagnetic field to a heating chamber in which an object to be heated is accommodated;

a steam generator that supplies steam to the heating chamber;

a door including a hinge in a wall of said apparatus, said door including an inner door wall facing toward an interior of said apparatus and an outer door wall facing toward an exterior of said apparatus; and a water tank including a supply port connected to said steam generator for supplying water to the steam generator, wherein said water tank is detachably installed between said inner door wall and said outer door wall, and wherein said water tank and said door are arranged such that said water tank is detached from said apparatus by opening said door about said hinge thereby also rotating said water tank about said hinge and then pulling said water tank out from between said inner door wall and said outer door wall to detach said supply port from said steam generator.

26. A high-frequency heating apparatus that supplies at least either a high frequency or steam to a heating chamber to heat an object to be heated, comprising:

a high frequency generator that supplies the high frequency to the heating chamber in which the object is accommodated;

a steam generator that supplies steam to the heating chamber;

a water tank for supplying water to the steam generator, said water tank adapted for being detachably arranged with said apparatus such that said tank is detached from said apparatus by rotating said tank away from an outside face of said apparatus and then pulling said tank away from said outside face; and a tank case covering the periphery of the water tank in the wall, wherein said tank case comprises:

a body of the tank case fixed on the side of the high-frequency heating apparatus, a tank case door member movably supported by an axis of the body of the tank case so that the tank case door member can be opened, the water tank being housed between the tank case door member and the body of the tank case, and door fitting means for fitting the tank case door member to the body of the tank case and holding the tank case door member in a closed state;

wherein a groove for dewatering formed toward a side end face on the reverse side to the vertical wall on the side of the heating chamber of the body of the tank case is provided at the bottom of the body of the tank case.

27. A high-frequency heating apparatus that supplies at least either a high frequency or steam to a heating chamber to heat an object to be heated, comprising:

a high frequency generator that supplies the high frequency to the heating chamber in which the object is accommodated;

a steam generator that supplies steam to the heating chamber;

a water tank for supplying water to the steam generator, said water tank adapted for being detachably arranged with said apparatus such that said tank is detached from said apparatus by rotating said tank away from an outside face of said apparatus and then pulling said tank away from said outside face; and a tank case covering the periphery of the water tank in the wall, wherein said tank case comprises:

a body of the tank case fixed on the side of the high-frequency heating apparatus, a tank case door member movably supported by an axis of the body of the tank case so that the tank case door member can be opened, the water tank being housed between the tank case door member and the body of the tank case, door fitting means for fitting the tank case door member to the body of the tank case and holding the tank case door member in a closed state, and a rib standing from the bottom of the body of the tank case for partitioning the bottom.

* * * * *